US007621779B2

(12) United States Patent
Laurx et al.

(10) Patent No.: US 7,621,779 B2
(45) **Date of Patent: *Nov. 24, 2009**

(54) HIGH-DENSITY, ROBUST CONNECTOR FOR STACKING APPLICATIONS

(75) Inventors: John C. Laurx, Aurora, IL (US); David E. Dunham, Aurora, IL (US); Timothy S. Elo, Naperville, IL (US); Gary Humbert, Geneva, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/395,561

(22) Filed: Mar. 31, 2006

(65) Prior Publication Data

US 2007/0021003 A1 Jan. 25, 2007

Related U.S. Application Data

(60) Provisional application No. 60/666,971, filed on Mar. 31, 2005.

(51) Int. Cl.
*H01R 13/648* (2006.01)

(52) U.S. Cl. ..... 439/607.07

(58) Field of Classification Search ..... 439/608, 439/108, 607, 101, 607.07
See application file for complete search history.

(56) References Cited

U.S. PATENT DOCUMENTS

| | | | | |
|---|---|---|---|---|
| 3,179,738 | A * | 4/1965 | De Lyon | 439/350 |
| 3,456,231 | A | 7/1969 | Paullus et al. | |
| 3,576,520 | A | 4/1971 | Stauffer | |
| 4,032,209 | A | 6/1977 | Rutkowski | |
| 4,655,518 | A | 4/1987 | Johnson et al. | |
| 4,797,123 | A | 1/1989 | Weber | |
| 4,820,169 | A | 4/1989 | Weber et al. | |
| 4,871,321 | A | 10/1989 | Johnson | |
| 5,584,728 | A | 12/1996 | Cheng | |
| 5,605,476 | A | 2/1997 | McNamara et al. | |
| 5,672,064 | A | 9/1997 | Provencher et al. | |
| 5,702,258 | A | 12/1997 | Provencher et al. | |
| 5,785,537 | A | 7/1998 | Donahue et al. | |
| 6,010,373 | A | 1/2000 | Donahue | |
| 6,149,447 | A | 11/2000 | Maeda et al. | |
| 6,227,894 | B1 | 5/2001 | Maeda et al. | |
| 6,582,250 | B2 | 6/2003 | Taylor et al. | |
| 6,626,692 | B2 | 9/2003 | Maeda et al. | |
| 6,843,687 | B2 | 1/2005 | McGowen et al. | |
| 6,851,980 | B2 * | 2/2005 | Nelson et al. | 439/608 |
| 7,114,964 | B2 * | 10/2006 | Winings et al. | 439/79 |

(Continued)

FOREIGN PATENT DOCUMENTS

| | | |
|---|---|---|
| EP | 0 924 812 | 6/1999 |

*Primary Examiner*—Neil Abrams
*Assistant Examiner*—Phuong Nguyen
(74) *Attorney, Agent, or Firm*—Stephen L. Sheldon

(57) ABSTRACT

A high speed connector includes a plurality of terminal assemblies in which two columns of conductive terminals are supported in an insulative support body, the body including an internal cavity disposed between the two columns of conductive terminals. The terminals are arranged in horizontal pairs, and the internal cavity defines an air channel between each horizontal pair of terminals arranged in the two columns of terminals. The terminals are further aligned with each other in each row so that horizontal faces of the terminals in the two rows face each other to thereby promote broadside coupling between horizontal pairs of terminals.

20 Claims, 29 Drawing Sheets

U.S. PATENT DOCUMENTS

2002/0098738 A1 7/2002 Astbury et al.
2004/0072470 A1 4/2004 Lang et al.
2004/0121652 A1 6/2004 Gailus
2004/0166704 A1 8/2004 Perugini et al.
2004/0224559 A1* 11/2004 Nelson et al. ..... 439/608
2007/0021000 A1* 1/2007 Laurx ..... 439/608
2007/0021001 A1* 1/2007 Laurx et al. ..... 439/608
2007/0021002 A1* 1/2007 Laurx et al. ..... 439/608
2007/0021003 A1* 1/2007 Laurx et al. ..... 439/608
2007/0021004 A1* 1/2007 Laurx et al. ..... 439/608

* cited by examiner

FIG.4A
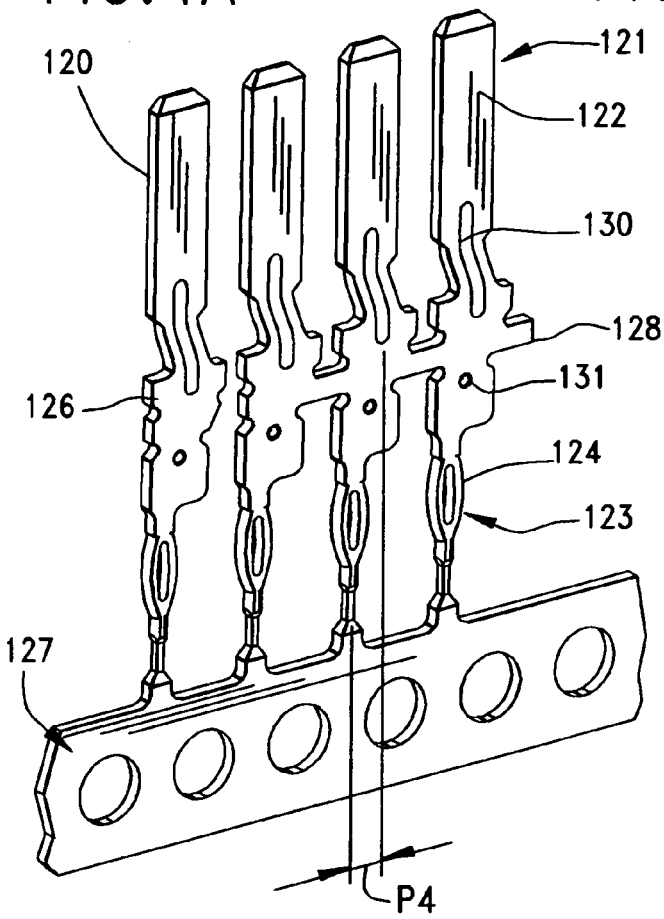
FIG.4B
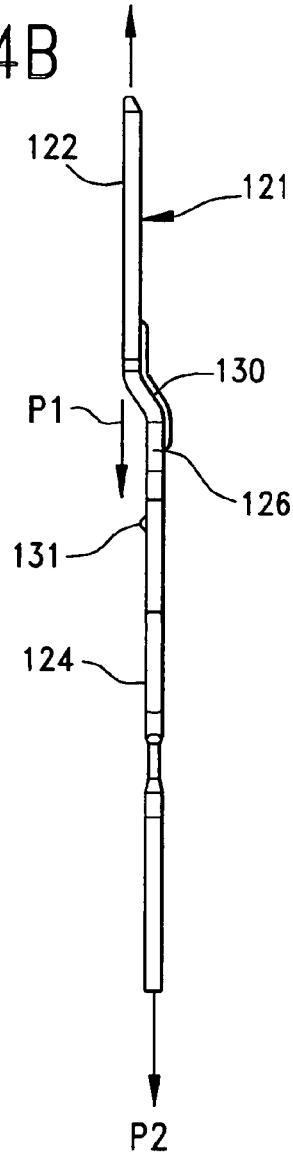
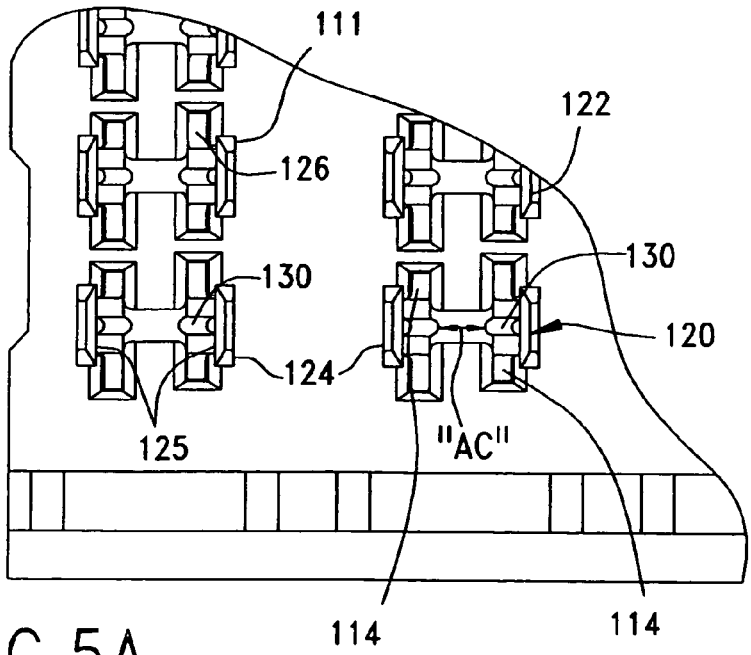
FIG.5A

FIG.5B
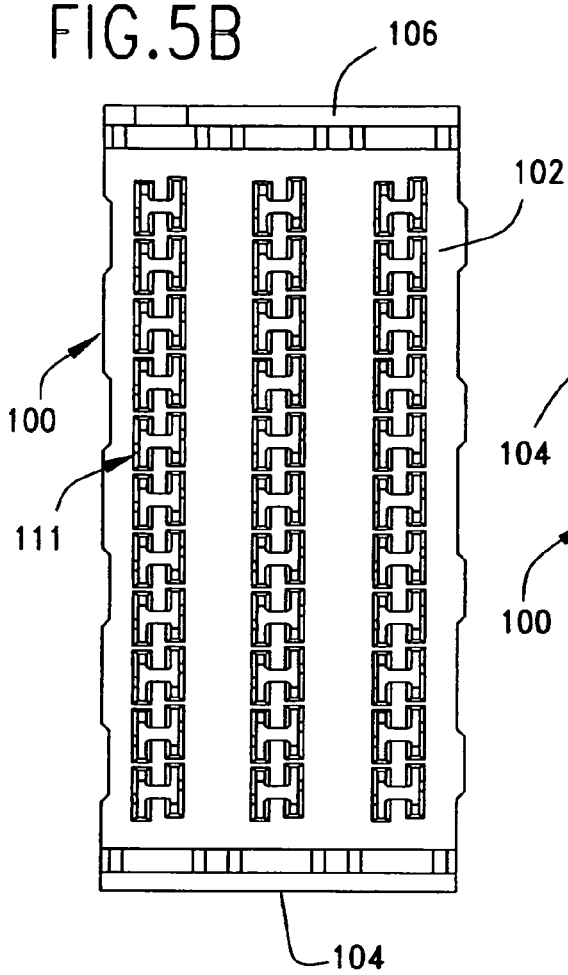
FIG.5D
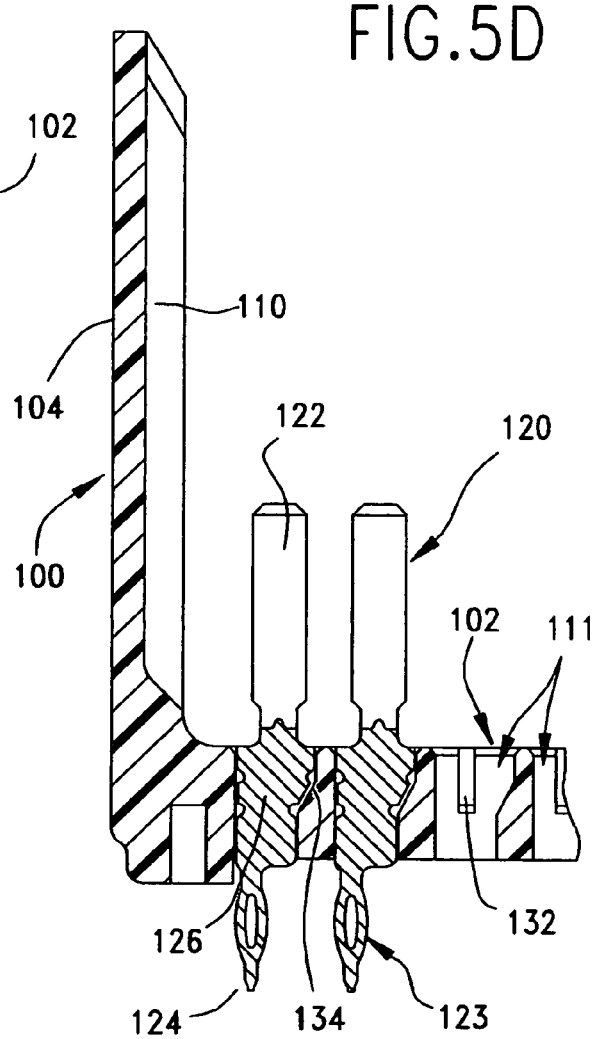
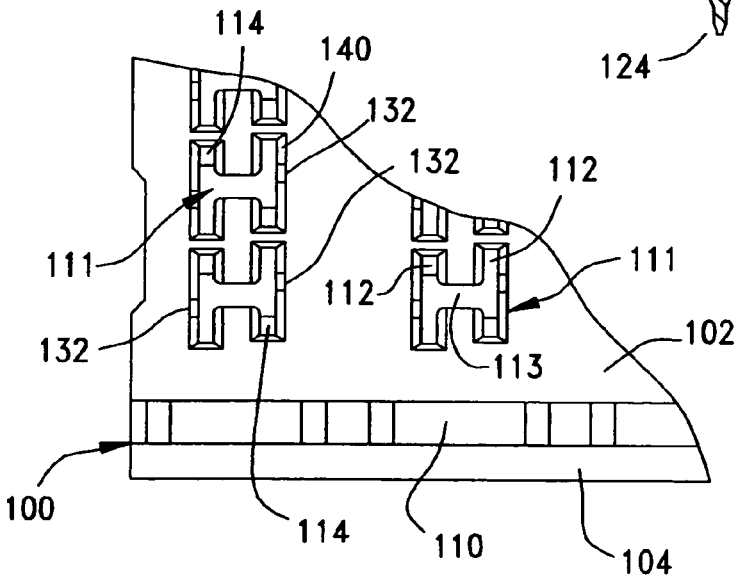
FIG.5C

FIG.23B
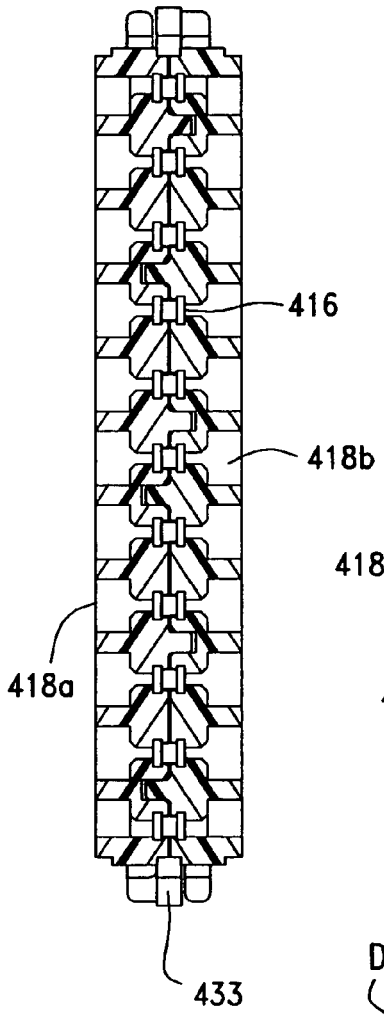
FIG.23A
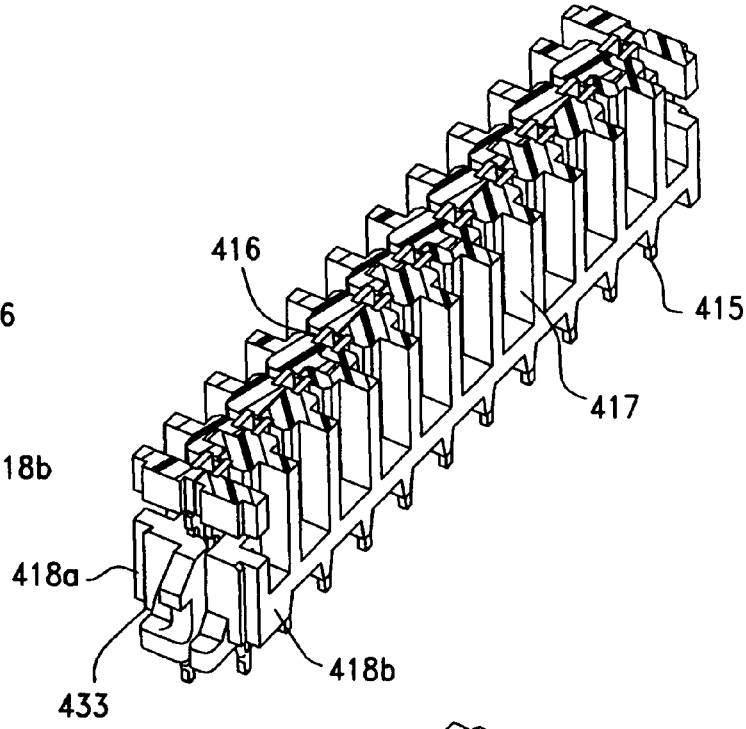
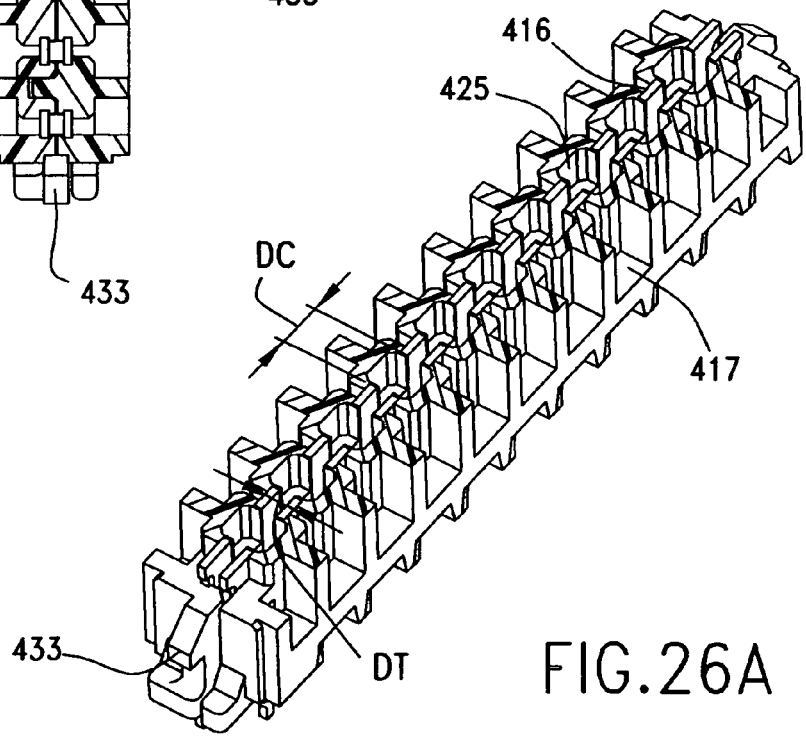
FIG.26A

HIGH-DENSITY, ROBUST CONNECTOR FOR STACKING APPLICATIONS

REFERENCE TO RELATED APPLICATIONS

This application claims priority of prior U.S. Provisional Patent Application No. 60/666,971, filed Mar. 31, 2005.

BACKGROUND OF THE INVENTION

The present invention pertains generally to electrical connectors, and more particularly to an improved connector suitable for use in backplane applications.

Backplanes are large circuit boards that contain various electrical circuits and components. They are commonly used in servers and routers in the information and technology areas. Backplanes are typically connected to other backplanes or to other circuit boards, known as daughter boards, which contain circuitry and components. Data transfer speeds for backplanes have increased as backplane technology has advanced. A few years ago, data transfer speeds of 1 Gigabit per second (Gb/s) were considered fast. These speeds have increased to 3 Gb/s to 6 Gb/s and now the industry is expecting speeds of 12 Gb/s and the like to be implemented in the next few years At high data transfer speeds, differential signaling is used and it is desirable to reduce the crosstalk and skew in such test signal applications to as low as possible in order to ensure correct data transfer. As data transfer speeds have increased, so has the desire of the industry to reduce costs. High speed signal transfer has in the past required the differential signal terminals to be shielded and this shielding increased the size and cost of backplane connectors because of the need to separately form individual shields that were assembled into the backplane connector.

These shields also increased the robustness of the connectors so that if the shields were to be eliminated, the robustness of the connector needed to be preserved. The use of shields also added additional cost in the manufacture and assembly of the connectors and because of the width of the separate shield elements, the overall relative size of a shielded backplane connector was large.

The present invention is directed to an improved backplane connector that is capable of high data transfer speeds, and that eliminates the use of individual shields and that is economical to produce and which is robust to permit numerous cycles of engagement and disengagement.

SUMMARY OF THE INVENTION

It is therefore a general object of the present invention to provide a new backplane connector for use in next generation backplane applications.

Another object of the present invention is to provide a connector for use in connecting circuits in two circuit boards together that has a high terminal density, high speed with low crosstalk and which is robust.

A further object of the present invention is to provide a connector for use in backplane applications in which the connector includes a plurality of conductive terminals arranged in rows and in which the rows comprise either signal or ground terminals and which are held in a support structure that permits the connector to be used in a stacking mating application.

Yet another object of the present invention is to provide a backplane connector assembly that includes a backplane header component and a wafer connector component that is matable with the backplane header component, the backplane header component having a base that sits on a surface of a backplane and two sidewalls extending therefrom on opposite ends defining a channel into which the wafer connector component fits, the backplane header component including a plurality of conductive terminals, each of the terminals including a flat contact blade portion, a compliant tail portion and a body portion interconnecting the contact and tail portions together so that they are offset from each other, the backplane header component including slots associated with terminal-receiving cavities thereof, the slots providing air gaps, or channels, between the terminals through the backplane header component.

An additional object of the present invention is to provide a wafer connector component in which two columns of conductive terminals are supported in an insulative support body, the body including an internal cavity disposed between the two columns of conductive terminals, the terminal being arranged in horizontal pairs of terminal, the cavity defining an air channel between each horizontal pair of terminals arranged in the two columns of terminals, and the terminals being further aligned with each other in each row so that horizontal faces of the terminals in the two rows face each other to thereby promote broadside coupling between horizontal pairs of terminals.

Yet another object of the present invention is to provide a header connector for use in backplane applications, that is, connecting two circuit boards together, the connector including a cover member, or shroud, that is supportable on a circuit board, the cover member having a hollow interior defined by opposing side and end walls, the cover member receiving a plurality of terminal assemblies therein, each of the terminal assemblies extending lengthwise between two opposing side walls, and each of the terminal assemblies supporting two rows of conductive terminals, the rows of terminal being aligned with each other so that the terminals of one row of each of the terminal assemblies are able to capacitively couple in a broadside manner, with the terminals of the other row of the terminal assembly, the terminals including bifurcated contact portions and compliant pin tail portions.

Still yet another object of the present invention is to provide a means for securing a plurality of terminal assemblies within the cover member of the header connector, the cover member side walls including at least one groove disposed therein, and the terminal assemblies including guides that project therefrom and which are received within the grooves, the terminal assemblies further including catches disposed on opposing ends thereof, the catches being received within engagement grooves formed in the cover member side walls and the catches fixing the terminal assemblies in place within the cover member, and the terminal assemblies including bifurcated contact arms as the contact portions of the terminals, the contact portions being held within the cover member.

The present invention accomplishes these and other objects by way of its structure. In one principal aspect, the present invention includes a backplane connector component that takes the form of a pin header having a base and at least a pair with sidewalls that cooperatively define a series of slots, or channels, each of which receives the mating portion of a wafer connector component. The base has a plurality of terminal receiving cavities, each of which receives a conductive terminal. The terminals have flat control blades and compliant tails formed at opposite ends. These contact blades and tails are offset from each other and the cavities are configured to receive them. In the preferred embodiment, the cavities are shown as having an H-shape with each of the legs of the H-shaped cavities receiving one of the terminals and the interconnecting arm of the H-shaped cavity remaining open to define an air channel between the two terminals. Such an air channel is present between pairs of terminals in each row of terminals in the horizontal direction to effect broadside coupling between the pairs of terminals.

In another principal aspect of the present invention, a plurality of wafer connector components are provided that mate with the backplane header. Each such wafer connector component includes a plurality of conductive terminals that are arranged in two vertical columns (when viewed from the mating end thereof), and the two columns defining a plurality of horizontal rows of terminals, each row including a pair of terminals, and preferably a pair of differential signal terminals. The terminals in each of the wafer connector component rows are aligned broadside together so that capacitive coupling may occur between the pairs in a broadside manner. In order to regulate the impedance of each pair of terminals, each wafer connector component includes a structure that defines an internal cavity, and this internal cavity is interposed between the columns of terminals so that an air channel is present between each of the pairs of terminals in each wafer connector component.

In another principal aspect of the present invention, the contact portions of the wafer connector component terminals extend forwardly of the wafer and are formed as bifurcated contacts that have a cantilevered contact beam structure. An insulative housing, or cover member, may be provided for each wafer connector component and in such an instance, the housing engages the mating end of each wafer connector component in order to house and protect the contact beams. Alternatively, the cover member may be formed as a large cover member that accommodates a plurality of wafer connector elements.

In the preferred embodiment of the invention, theses housings or cover members have a U-shape with the legs of the U-shape engaging opposing top and bottom edges of the wafer connector component and the base of the U-shape providing a protective shroud to the contact beams. The base (of face, depending on the point of view) of the U has a series of I or H-shaped openings formed therein that are aligned with the contact portions of the terminals and these openings define individual air channels between the contact beams so that the dielectric constant of air may be used for broadside coupling between the terminal pairs through substantially the entire path of the terminals through the wafer connector component.

In another embodiment of the invention, the internal cavity of the wafer connector component is sized to receive an insert member, and this insert member may be an engineered dielectric that has a desired dielectric constant that will influence the coupling that occurs between the pairs of terminals. In this manner, the impedance of the connector assembly may be tuned to an approximate desired level.

The header connector embodiment of the invention utilizes an formed cover member that houses a plurality of terminal assemblies, each in the form of a reduced height wafer, as compared to the backplane embodiment of the present invention. Each such wafer is composed of two interengaging parts with an insulative plastic frame holding two spaced-apart rows of conductive terminals. The terminals are arranged to face each other broadside and an air channel is provided between sequential pairs of terminals in the assembly, from the terminal contact portions to the terminal tail portions.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 4A is a perspective view of a series of terminals used in the backplane connector member of FIG. 4 and shown attached to a carrier strip to illustrate a manner in which they are formed;

FIG. 4B is a an end view of one of the terminals of FIG. 4A, illustrating the offset configuration of the terminal;

FIG. 5A is an enlarged plan view of a portion of the backplane member of FIG. 5, illustrating the terminals in place within the terminal-receiving cavities thereof;

FIG. 5B is the same plan view of the backplane member of FIG. 5, but with the terminal-receiving cavities thereof empty;

FIG. 5C is an enlarged plan view of a portion of FIG. 5B, illustrating the empty terminal-receiving cavities in greater detail;

FIG. 5D is a an enlarged detail sectional view of a portion of the backplane member illustrating two terminals of the type shown in FIG. 4A in place therein;

FIG. 23A is a cross-sectional view taken along lines A-A of FIG. 23 and aligned with the standoff portions of the connector elements;

FIG. 23B is a top plan view of FIG. 23A;

DETAILED DESCRIPTION OF THE PREFERRED EMBODIMENTS

Figure 1:
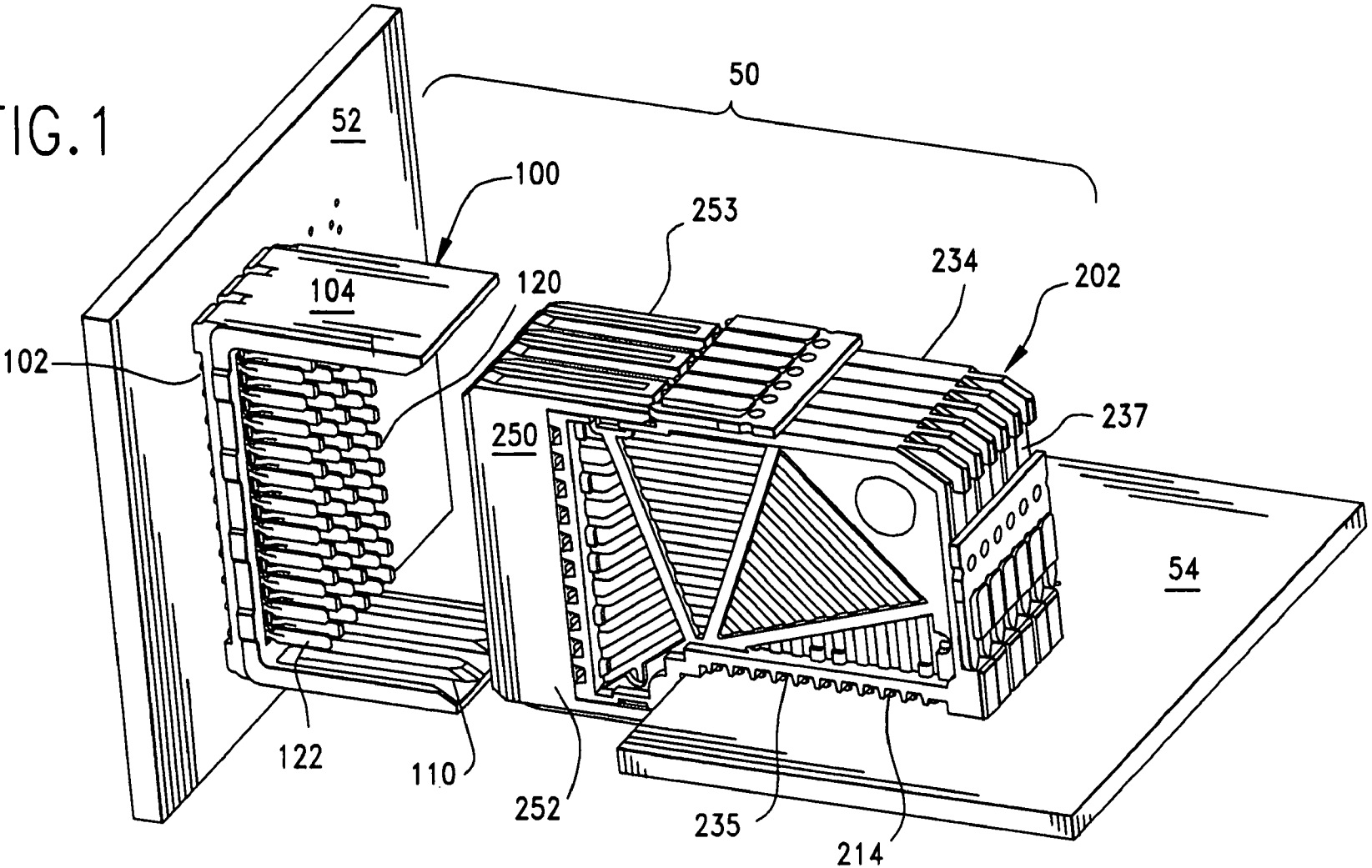
FIG. 1 is a perspective view of a backplane connector assembly constructed in accordance with the principles of the present invention and shown in a conventional right-angle orientation to join the electrical circuits on two circuit boards together.

FIG. 1 illustrates a backplane connector assembly 50 constructed in accordance with the principles of the present invention. The assembly 50 is used to join together two circuit boards 52, 54 with the circuit board 52 representing a backplane and the circuit board 54 representing an ancillary, or daughter board.

Figure 3:
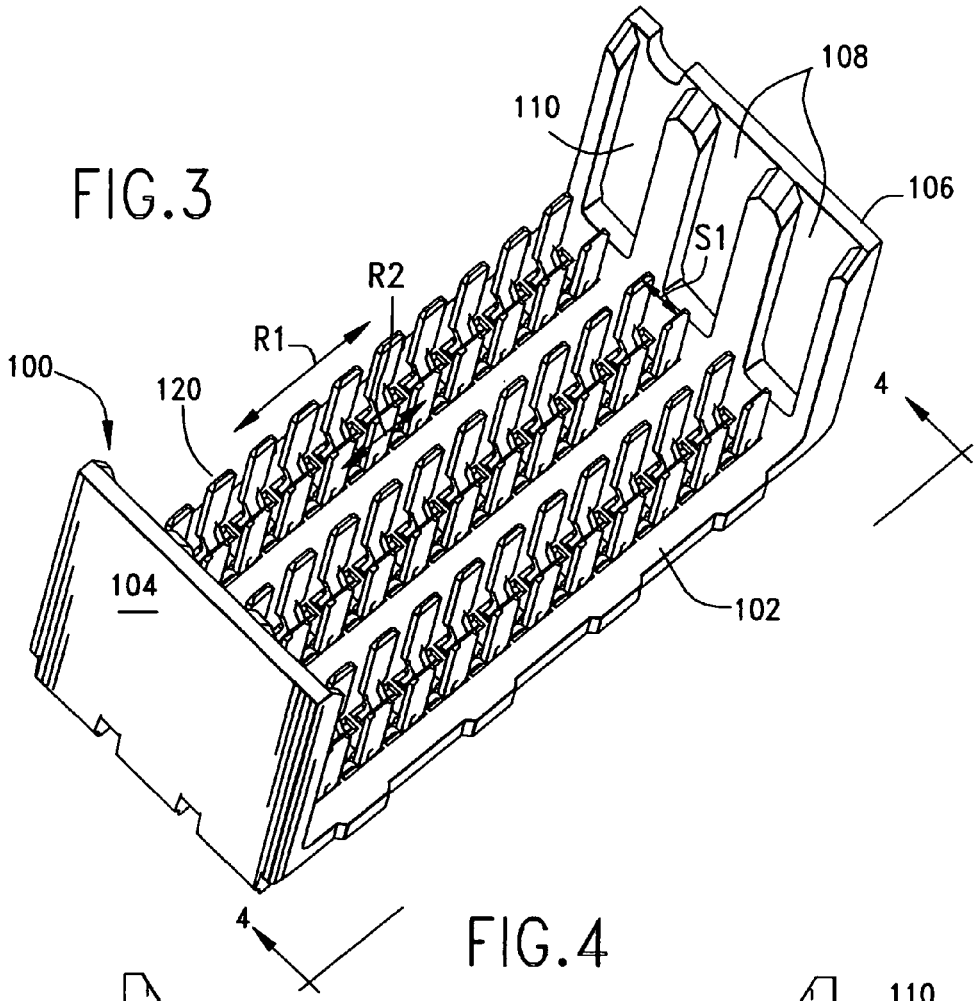
FIG. 3 is a perspective view of the backplane connector component of the backplane connector assembly of FIG. 1.

The assembly 50 can be seen to include two interengaging, or mating, components 100 and 200. One component 100 is mounted to the backplane board 52 and is a backplane member that takes the form of a pin header. In this regard, the backplane member 100, as illustrated best in FIGS. 1 and 3, includes a base portion 102 with two sidewalls 104, 106 rising up from the base portion 102. These two sidewalls 104, 106 serve to define a series of channels, or slots 108, each slot of which receives a single wafer connector component 202. In order to facilitate the proper orientation of the wafer connector components 202 within the backplane connector component, the sidewalls 104, 106 are preferably formed with interior grooves 110 that are vertically oriented and each such groove 110 is aligned with two rows R1, R2 of conductive terminals 120. (FIG. 3.)

Figure 4:
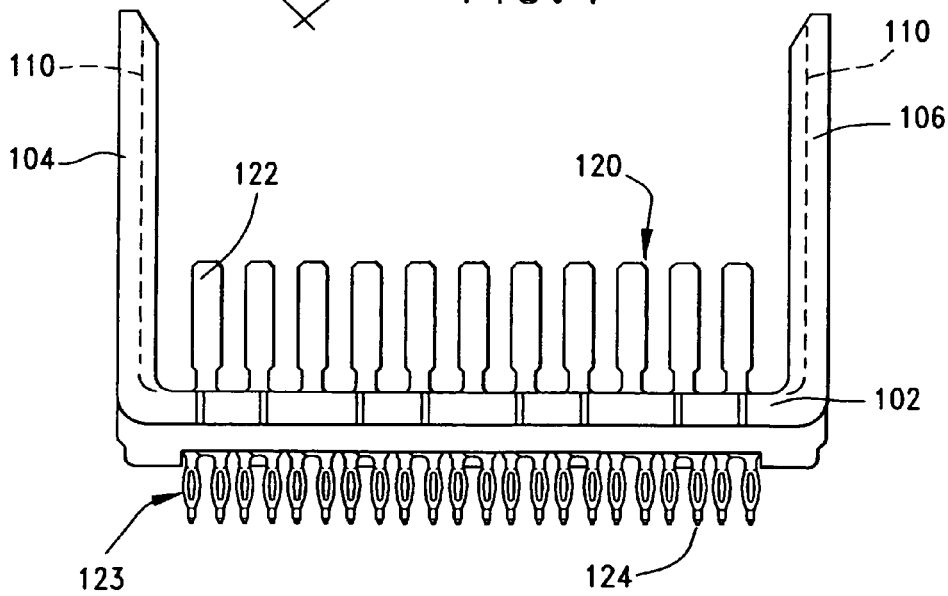
FIG. 4 is an end view of FIG. 3 taken along the line 4-4.

As shown in FIG. 4B, the header terminals 120 are formed in an offset manner so that their contact portions 121, which take the form of long, flat blades 122 extend in one plane P1, while thin tail portions 123, shown as compliant pin-style tails 124 extend in another plane P2, that is spaced apart from the first plane P1. The terminals 120 each include a body portion 126 that is received within a corresponding terminal-recovery cavity 111 that is formed in the base portion 102 of the backplane member 100. FIG. 4A illustrates the terminals 120 in one stage as they are stamped and formed along a carrier strip 127, and it can be seen that each terminal is interconnected together not only by the carrier strip 127, but also secondary pieces 128 that hold the terminals 120 in line during their forming process. These secondary pieces 128 are removed later in the forming process as the terminals 120 are removed, or singulated and then are inserted into the base 102 of the backplane member 100, such as by stitching.

Figure 5:
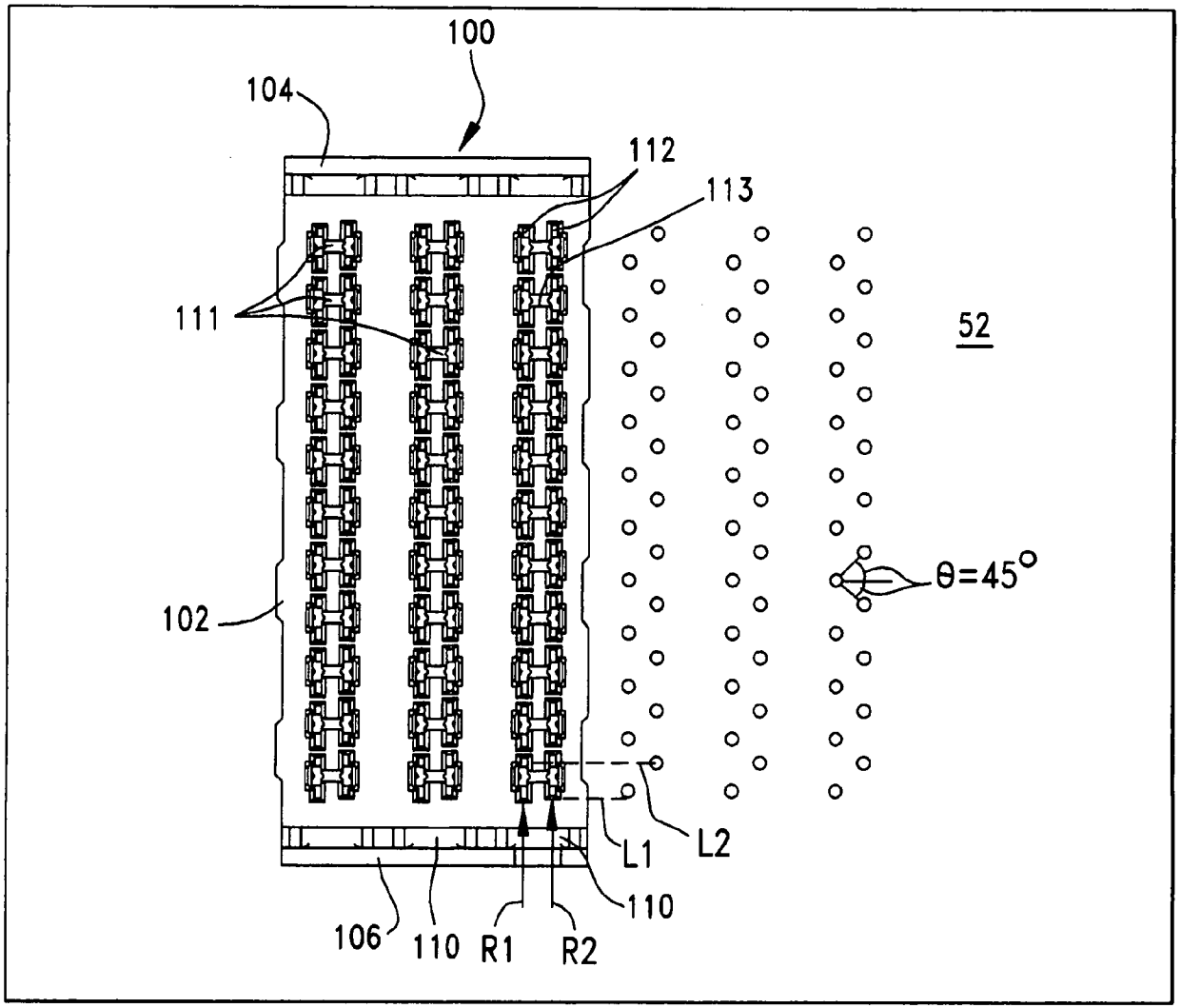
FIG. 5 is a top plan view of the backplane connector component in place on a circuit board and illustrating the tail via pattern used for such a component.

The contact blade portions 122 of the terminals 120 and their associated body portions 126 may include ribs 130 that are stamped therein and which preferably extend through the offset bends of the terminals 120. These ribs 130 serve to strengthen the terminals 120 by providing a cross-section to the terminals in this area which is better resistant to bending during insertion of the terminals 120 as well as mating with the terminals 206 of an opposing wafer connector component 202. Dimples 131 may also be formed in the terminal body portion 126 and in a manner such they project out to one side of each terminal 120 (FIG. 4B) and form a projection that will preferably interferingly contact one of the sidewalls of the terminal-receiving cavities 111 in the backplane member base portion 102. As illustrated in FIG. 5D, the backplane member base portion 102 may include a series of slots 132 formed which extend vertically and which will receive the terminal dimples 131 therein. The terminal-receiving cavities 111 are also preferably formed with interior shoulders, or ledges 134, which are best shown in FIG. 5D and which provide a surface against which the terminal body portions 126 rest.

As shown in FIG. 4A, the header terminals 120 preferably have their tail portions 123 offset as well. As shown, this offset occurs laterally of the terminals 120, so that the centerlines of the tail portions 123 are offset from the centerlines of the contact portions 121 by a distance P4. This offset permits, as clearly shown in FIG. 5, pairs of header terminal 120 to face each other and utilize the 45-degree orientation of vias shown in the right half of FIG. 5. As can be determined from FIG. 5, the compliant pin tail of one of the two rows R1 can use the bottom left via, while the compliant pin tail of the facing terminal can take the next via in the right row, and then with the pattern repeated for each pair, the vias of the header terminals, within each two rows are at 45 degree angles to each other, as shown diagrammatically to the right of FIG. 5. This facilitates the route out for such connectors on the circuit boards to which they are mounted.

As seen best in FIGS. 5A & 5C, the terminal-receiving cavities 111 of the backplane member 100 of the connectors of the invention are unique in that they are generally H-shaped, with each H-shape having two leg portions 112 that are interconnected by an arm portion 113. While the leg portions 112 of the H-shaped cavities 111 are filled with the body portions 126 of the terminals 120, the arm portions 113 of each cavity 111 remain open so that an air channel "AC" is defined in the arm portion 113 (FIG. 5A), the purpose of which will be explained in greater detail below. The spacing that results between the two terminal contact portions 122 is selected to match the approximate spacing between the two contact portions 216 of the wafer connector component terminals 206 that are received within the backplane member channels 110.

The H-shaped cavities 111 also preferably include angled edges 140, that define lead-in surfaces of the cavities 111 that facilitate the insertion of the terminals 120 therein, especially from the top side of the connector base 102. The cavities 111 include tail holes 114 that, as shown in FIG. 5A, are located at opposite, angled corners of each H-shaped opening 111. The contact blade portions 122 of the terminals 120, are located above and slightly outboard of the leg portions 112 of the H-shaped cavities 111. This is due to the offset form present in their body portions 126, and this is best shown in a comparison between FIGS. 5A and 5B. FIG. 5B illustrates in an enlarged detail plan view, the backplane member base portion 102 without any terminals 120 present in the terminal-receiving cavities 111, while FIG. 5A illustrates, also in an enlarged top plan view, the terminal-receiving cavities 111 being filled with the terminals 120. In FIG. 5A, one can see that the contact blade portions extend outwardly into the areas between the rows of terminals so that the outer surfaces 124 thereof are offset from the outermost inner edges 141 of the base member terminal-receiving cavities 111.

Figure 6:
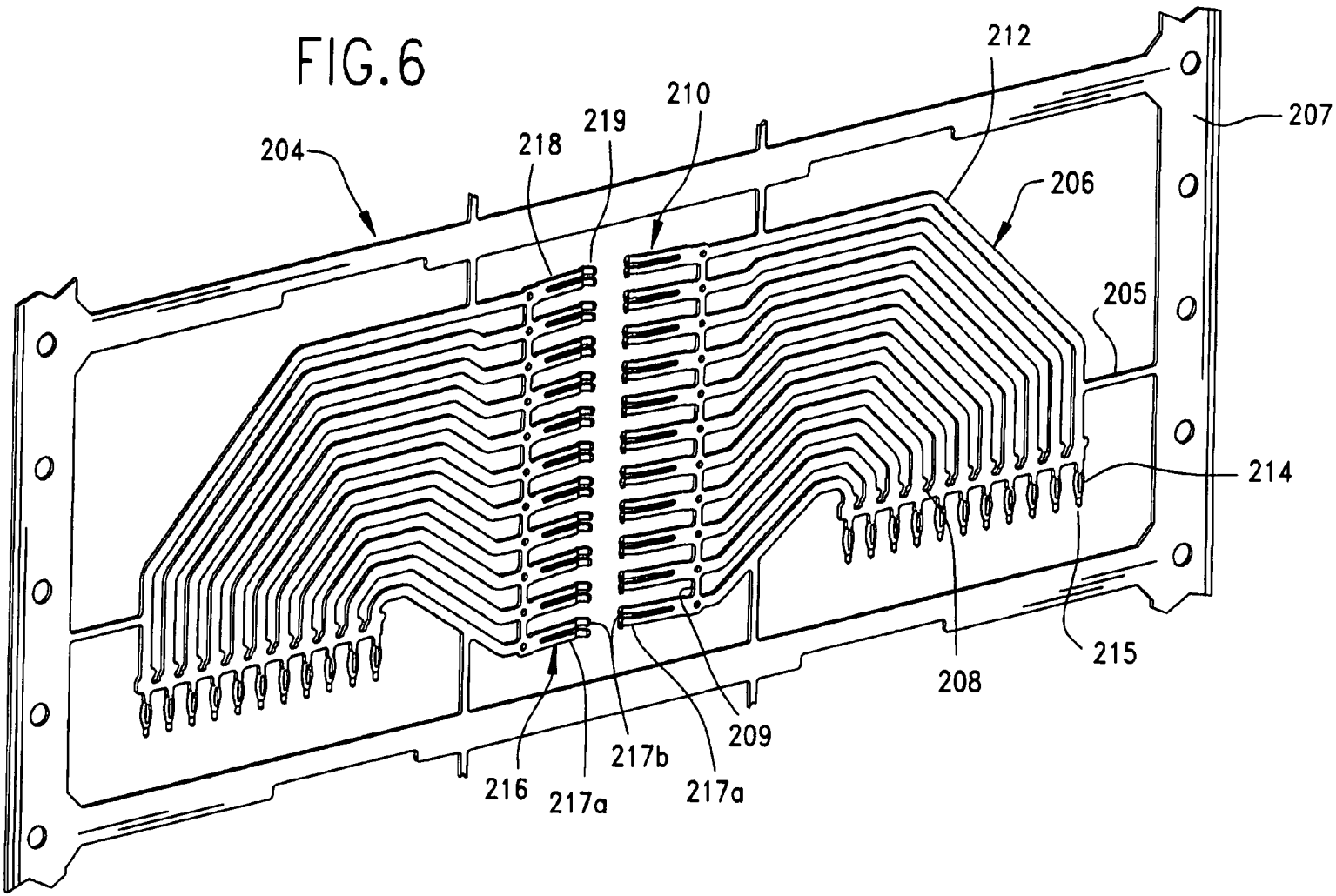
FIG. 6 is a perspective view of a stamped lead frame illustrating the two arrays of terminals that will be housed in a single wafer connector component.

FIG. 6 illustrates a metal lead frame 204 which supports a plurality of conductive terminals 206 that have been stamped and formed in preparation for subsequent molding and singulation. The lead frame 204 shown supports two sets of terminals 206, each set of which is incorporated into an insulative support half 220*a*, 220*b*, which are subsequently combined to form a single wafer connector component 202. The terminals 206 are formed as part of the lead frame 204 and are held in place within an outer carrier strip 207 and the terminals are supported as a set within the lead frame 204 by first support pieces, shown as bars 205, that interconnect the terminals to the lead frame 204 and also by second support pieces 208 that interconnect the terminals together. These support pieces are removed, or singulated, from the terminal sets during assembly of the wafer connector components 202.

Figure 7:
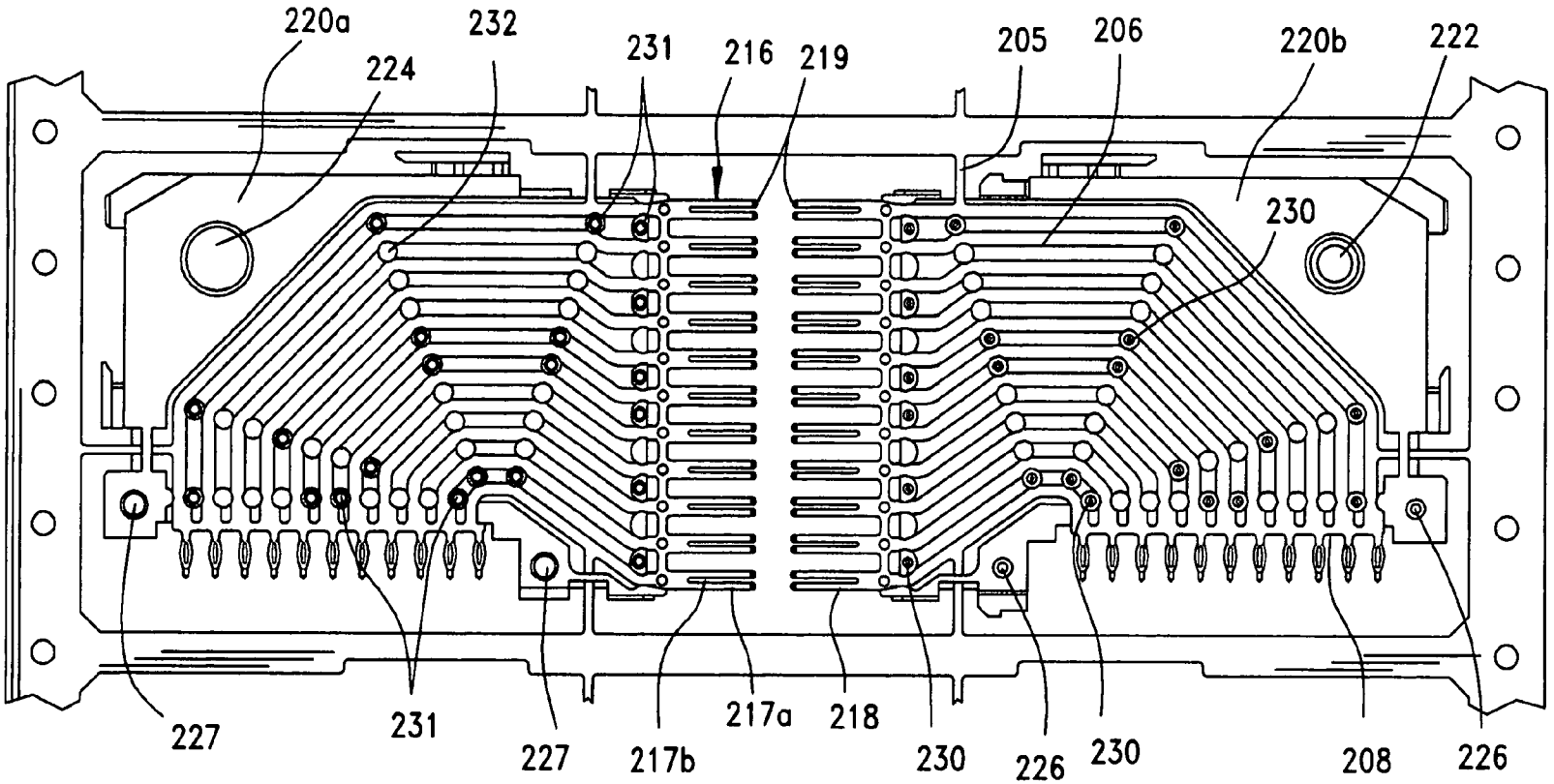
FIG. 7 is an elevational view of the lead frame of FIG. 6, taken from the opposite side thereof and showing the wafer halves formed over the terminals.

FIG. 7 illustrates the lead frame 204 with the support, or wafer halves 220*a*, 220*b* molded over portions of the set of eleven individual terminals 206. In this stage, the terminals 206 are still maintained in a spacing within the support halves by the support halve material and by the second interconnecting pieces 208, 209 that are later removed so that each terminal stands 206 by itself within the completed wafer connector component 202 and is not connected to any other terminal. These pieces 208, 209 are arranged outside of the edges of the body portions of the wafer connector component halves 220*a*, 220*b*. The support halves 220*a*, 220*b* are symmetric and are aptly described as mirror images of each other.

Figure 7A:
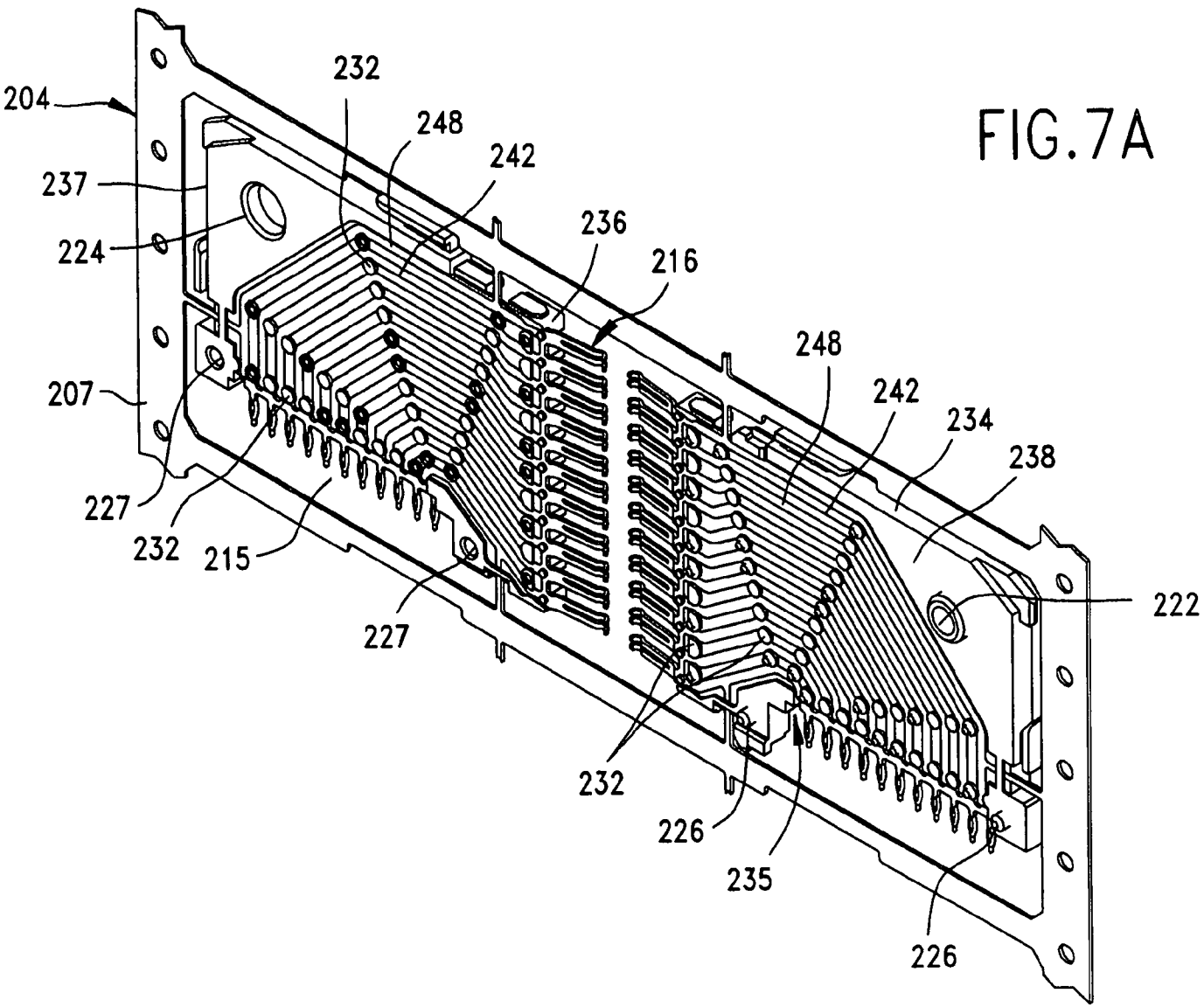
FIG. 7A is the same view of FIG. 7, but in a perspective view.

FIG. 7A illustrates best the structure which is used to connect the two wafer halves 220*a*, 220*b* together, which are shown as complimentary relatively large-shaped posts 222 and openings, or holes 224. One large post 222 and large opening 224 are shown in FIG. 7A and they are positioned within the body portion 238 of the connector component halves 220*a*, 220*b*. Three such posts 220 & 226 are shown as formed in the body portions of the wafer connector halves 220*a*, 220*b* and the other posts 230, as shown, are much smaller in size, and are positioned between selected terminals and are shown extending out of the plane of the body portion 220*b*. These posts 230 extend from what may be considered as standoff portions 232 that are formed during the insert molding process, and the standoff portions 232 serve to assist in the spacing between terminals within each wafer half and also serve to space the terminals apart in their respective rows when the halves are assembled together.

Figure 14:
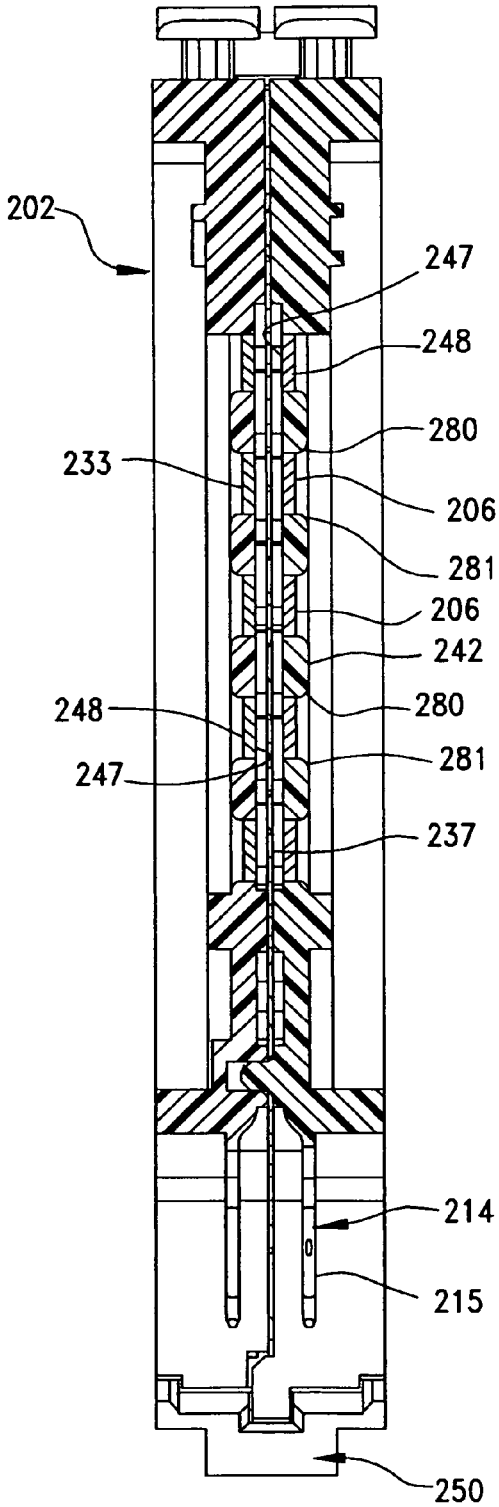
FIG. 14 is a sectional view of the wafer connector component of FIG. 11, taken along vertical line 14-14 thereof.
Figure 15:
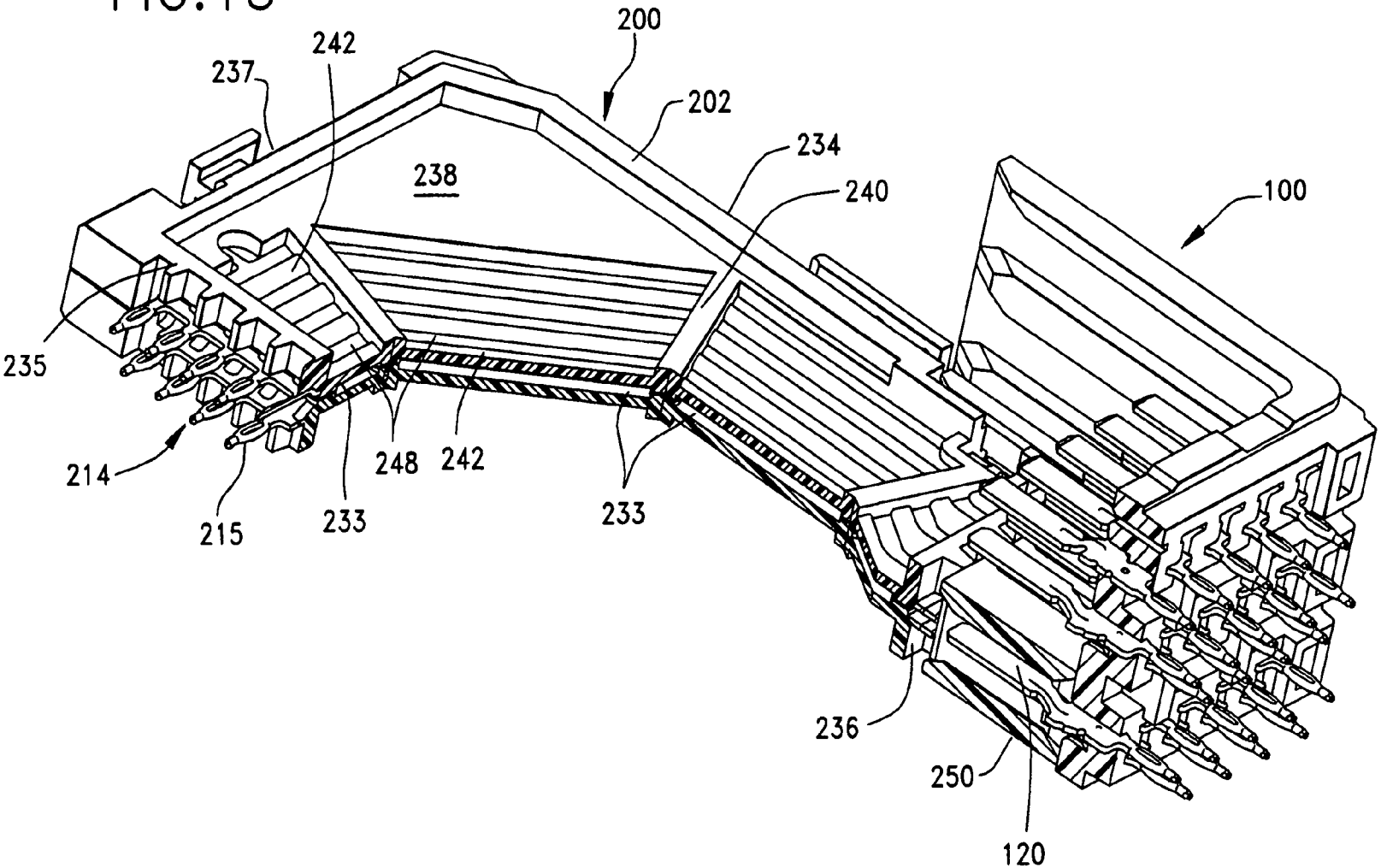
FIG. 15 is a perspective view, partly in section of a wafer connector component and backplane member mated together.
Figure 17:
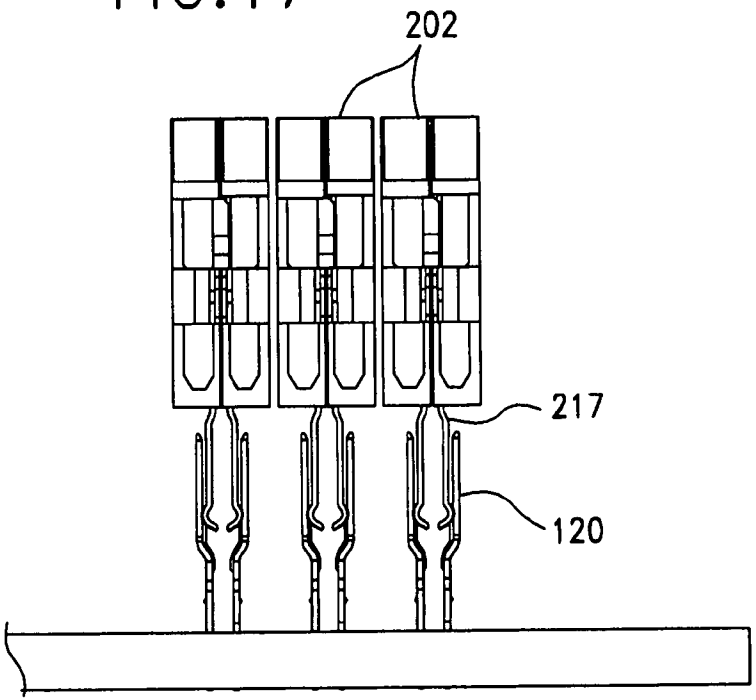
FIG. 17 is a similar view to FIG. 16, but with the wafer connector component terminals being supported by their respective connector component supports.
Figure 16:
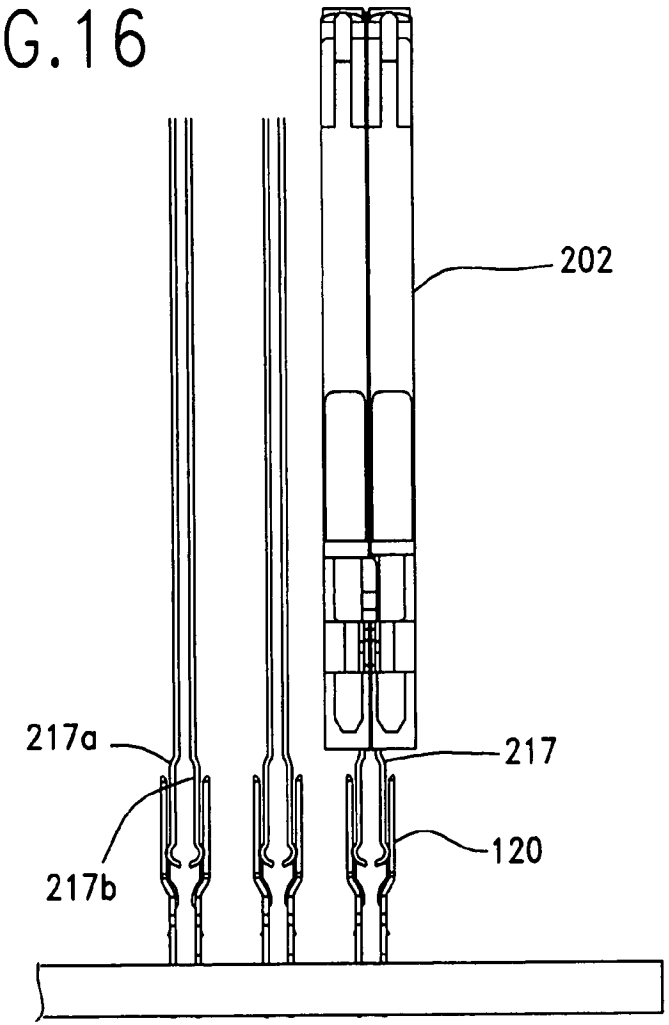
FIG. 16 is an end diagrammatic view of the wafer connector component and backplane member mated together with the cover member removed for clarity to illustrate the manner of mating with connectors of the present invention.

These smaller posts are respectively received within corresponding openings 231, which similar, to the posts 230, are preferably formed as part of selected ones of the standoff portions 232. In an important aspect of the present invention, no housing material is provided to cover the inner faces of the terminal sets so that when the wafer connector components are assembled together, the inner vertical sides, or surfaces 247 of each pair of terminals 206 are exposed to each other. The posts and openings 230, 231 and the standoff portions 232 are cooperate in defining an internal cavity within each wafer connector component 202, and this cavity 237 is best seen in the sectional views of FIGS. 12 & 14.

Figure 8:
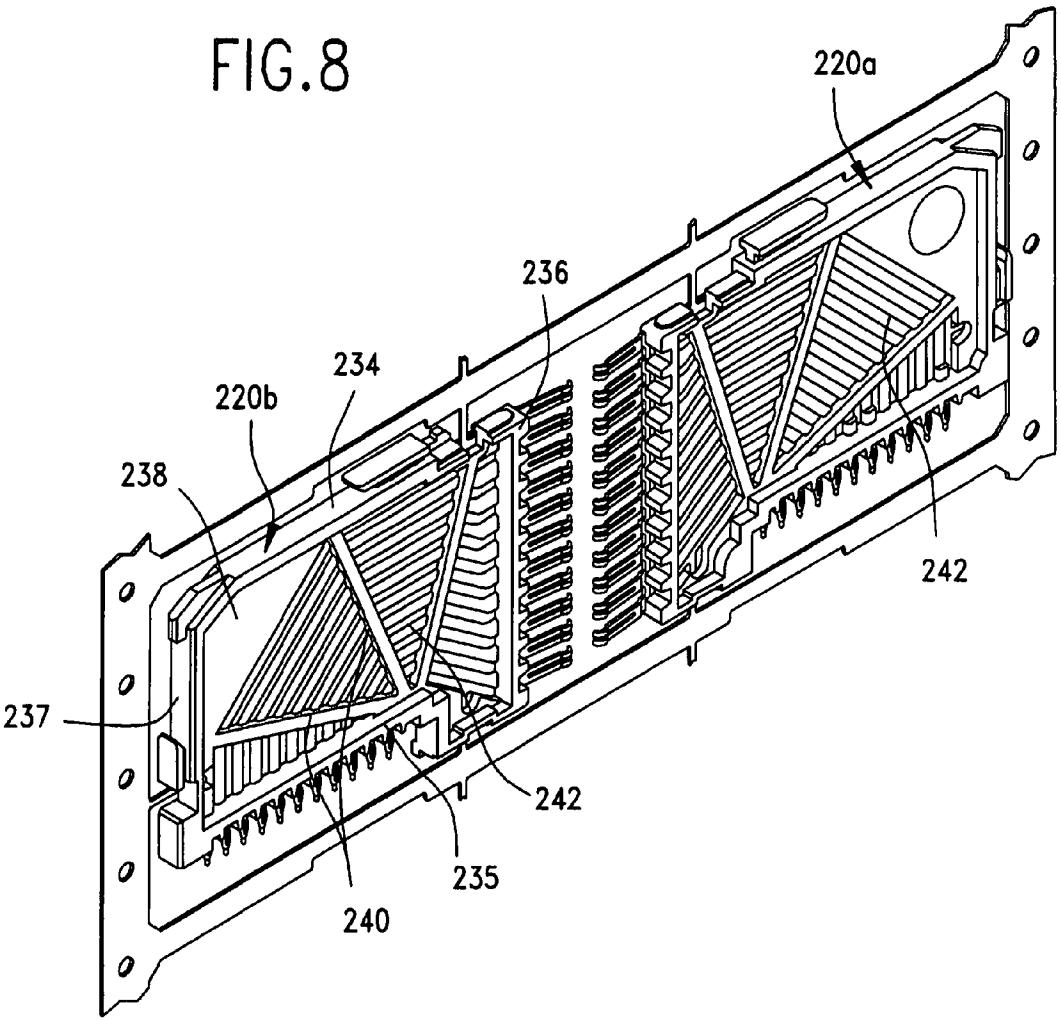
FIG. 8 is a perspective view of FIG. 7 but taken from the opposite side thereof.

FIG. 8 shows the opposite, or outer sides, of the wafer connector components and it can be seen that the wafer connector components halves 220*a*, 220*b* form what may be aptly described as a skeletal framework that utilizes structure in the form of cross braces 240 and interstitial filler pieces, or ribs 242, that extend between adjacent terminals in the vertical direction, and which preferably contact only the top and bottom edges of adjacent terminals. In this manner, the exterior surfaces 248 of the terminals (FIG. 9) are also exposed to air, as are the inner surfaces 247 of the terminals 206. These filler ribs 242 are typically formed from the same material from which the wafer connector component body portions 238 are made and this material is a preferably a dielectric material. The use of a dielectric material will deter significant capacitive coupling from occurring between the top and bottom edges 280, 281 of the terminals (FIG. 14), while driving the coupling that does occur, to occur in a broadside manner between pairs of terminals arranged horizontally.

Figure 9:
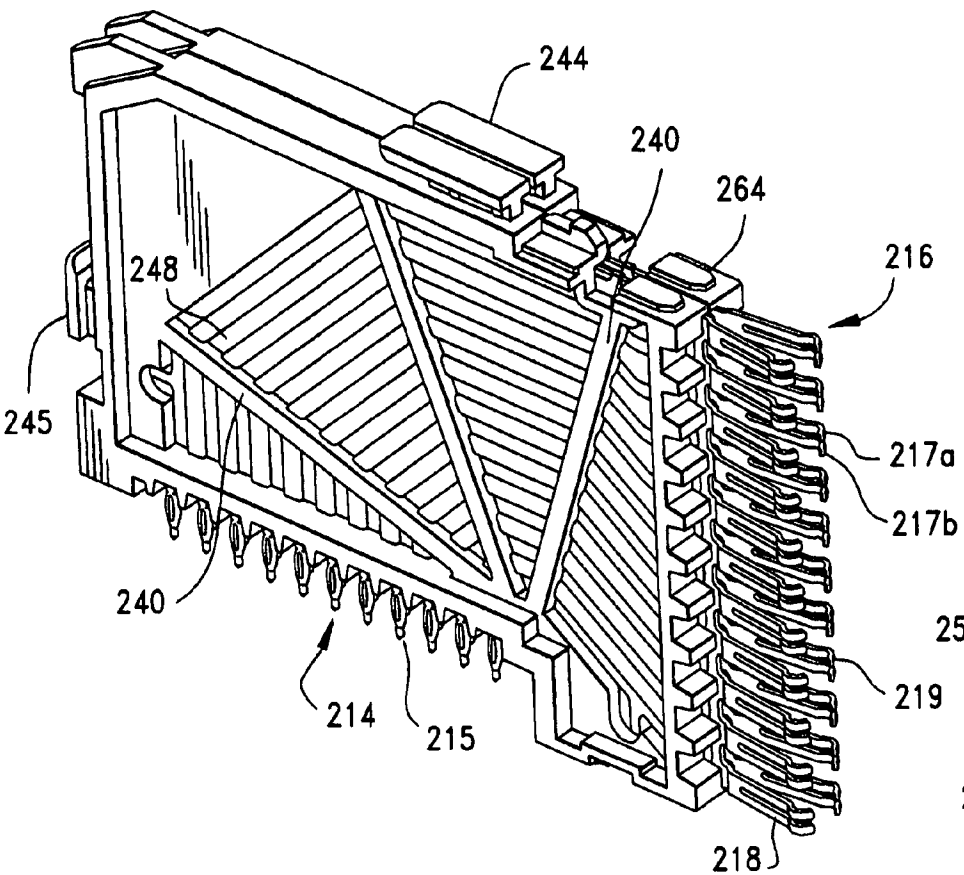
FIG. 9 is a perspective view of the two wafer halves of FIG. 8, assembled together to form a single wafer connector.
Figure 18B:
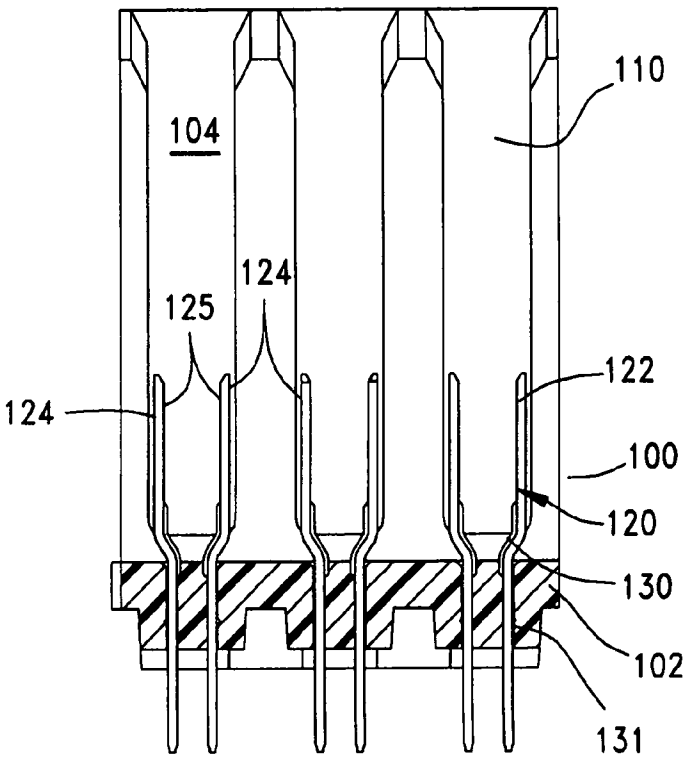
FIG. 18B is the same view as FIG. 18A, but with the wafer connector component removed from clarity.
Figure 18A:
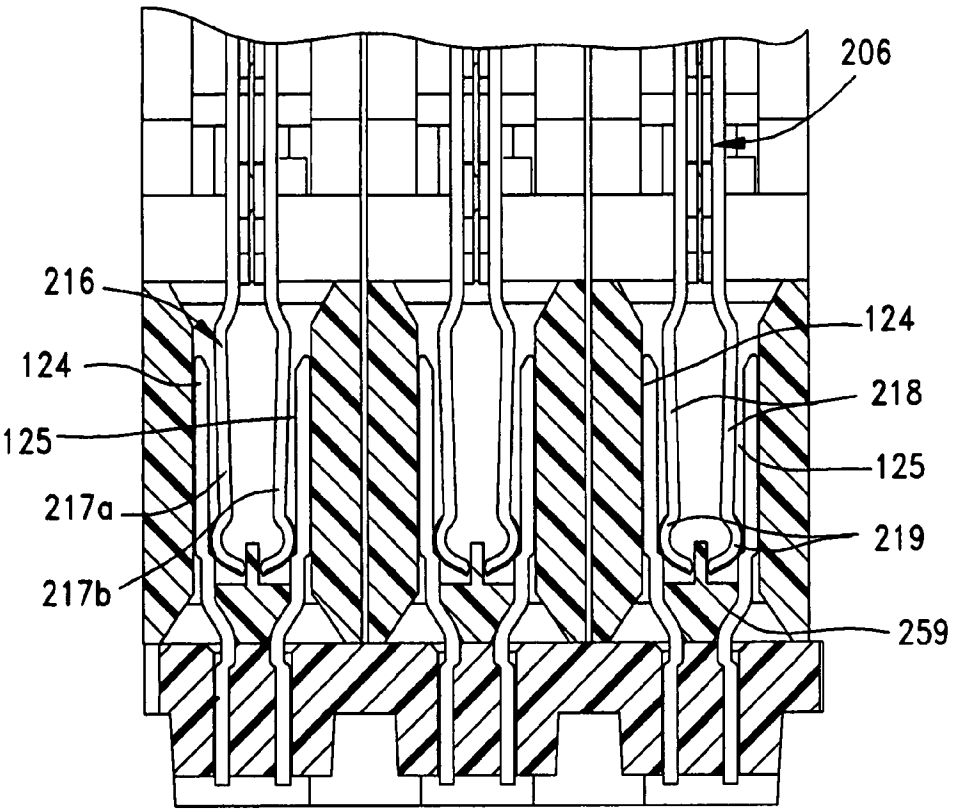
FIG. 18A is an enlarged sectional detail view of the mating interface between the wafer connector component and the backplane member, and showing the component and member.

FIG. 9 illustrates a completed wafer connector component that has been assembled from two halves. The terminals of this wafer connector component have contact and tail portions arranged along two edges and in the embodiment shown, the edges may be considered as intersecting or perpendicular to each other. It will be understood that the edges could be parallel or spaced apart from each other as might be used in an interposer-style application. The first set of contact portions 216 are the dual beam contact portions 217*a*, 217*b* that are received in the central portion of the backplane member 100 of the assembly, while the second set of contact portions 214 serve as tail portions and as such, utilize compliant pin structures 215 so that they may be removably inserted into openings, or vias, of circuit boards. The contact portions 216 of the wafer connector component 202 are formed as dual beams 217 and they extend forwardly of a body portion of each terminal. The ends of the terminal contact portions 216 are formed into curved contact ends 219 that are at the ends of the bodies 218 of the contact beams. These curved ends 219 face outwardly so that they will ride upon and contact the flat blade contacts 122 of the backplane member terminals 120. (FIG. 18A.)

Figure 19:
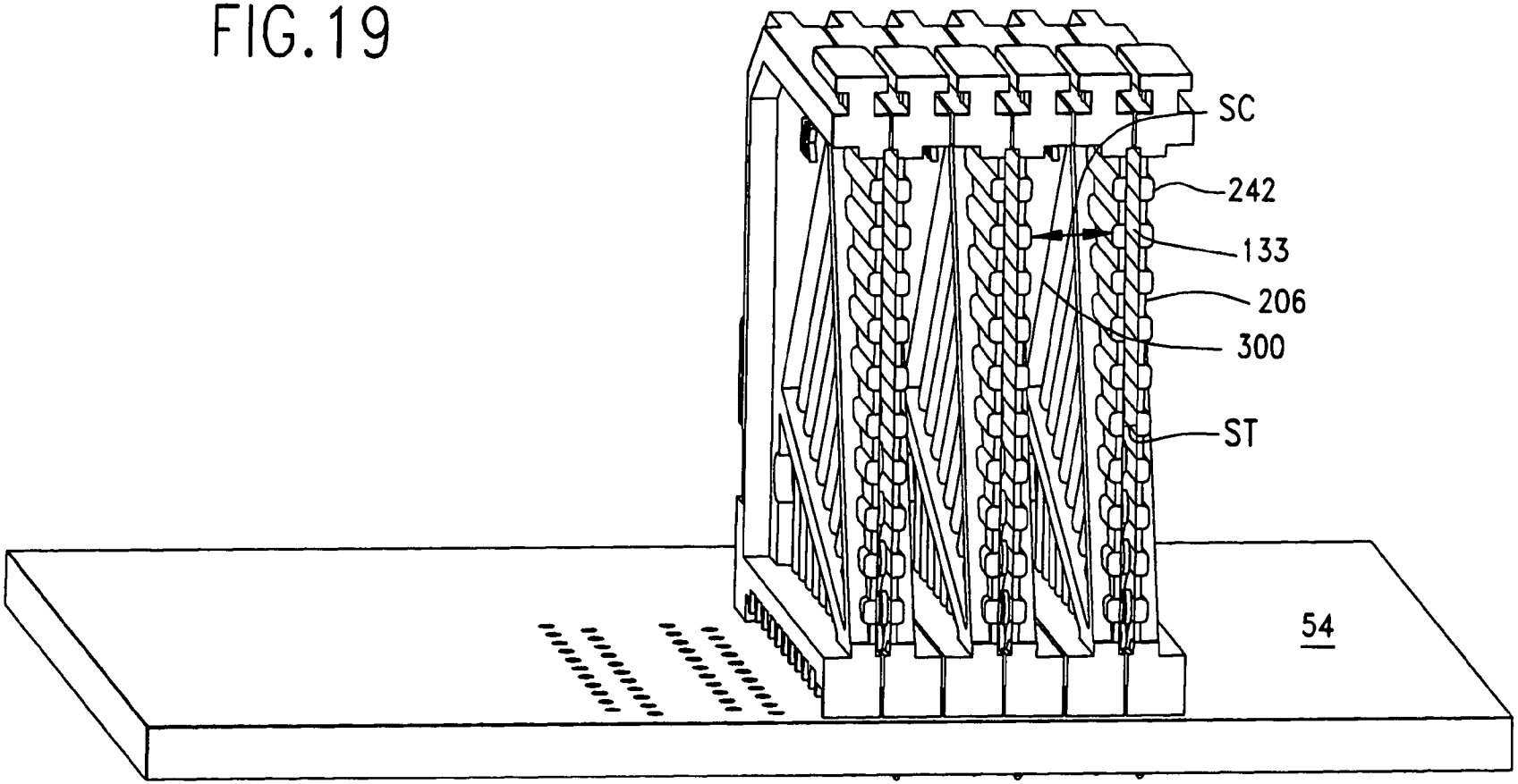
FIG. 19 is an angled end sectional view of three wafer connector components in place upon a circuit board, illustrating the air gaps between adjacent signal pairs and the air gap between adjacent wafer connector components.
Figure 20:
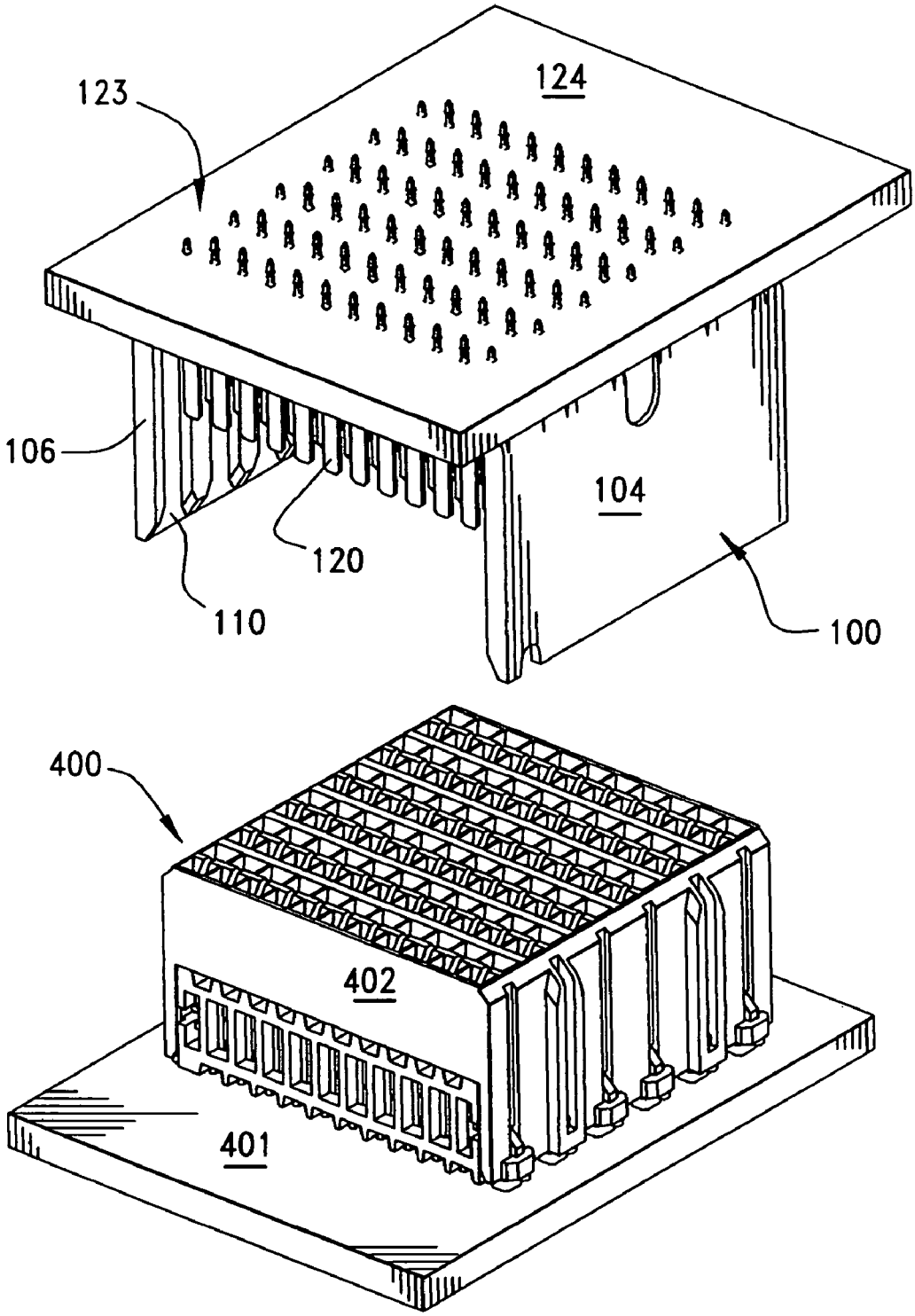
FIG. 20 is a perspective view of an alternate embodiment of a connector, specifically a header connector mounted to a circuit board and an opposing pin header, also mounted to a circuit board, and these two connectors are used in a "stacking" type of application.

When assembled together as a unit of wafers, there is present not only the air channel 133 between the terminals 206 within each wafer connector component 202, but also an air spacing 300 between adjacent wafer connector components, as shown in FIG. 19. The terminals are preferably spaced apart a first preselected distance ST uniformly through out the connector assembly, which defines the dimension of the air channel. This spacing is between designated pairs of terminals in each of the connector elements and this spacing is the same on an edge-to-edge basis within each connector element. Preferably, the spacing SC between connector elements, is greater than the spacing ST. (FIGS. 19 & 20.) This spacing helps create isolation between wafer connector elements.

Figure 10:
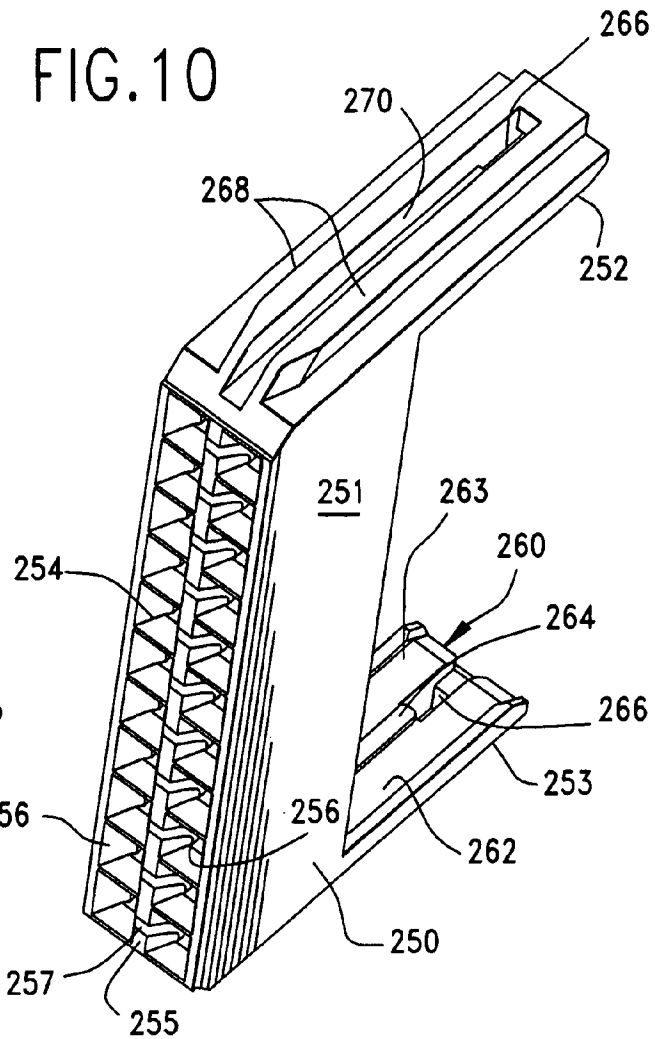
FIG. 10 is a perspective view of a cover member used with the wafer connector of FIG. 9.
Figures 11, 13A:
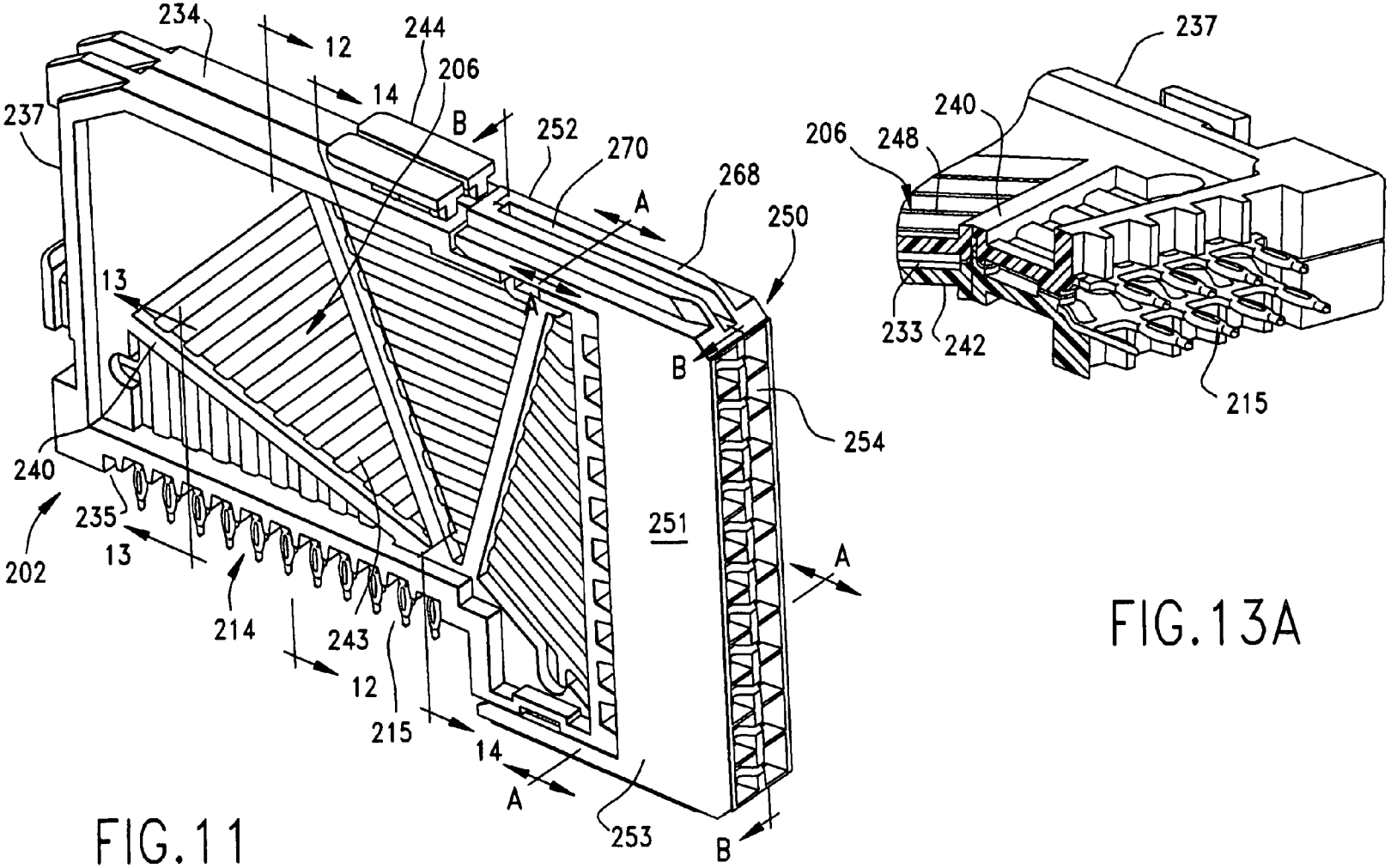
FIG. 11 is the same view as FIG. 9, but with the cover member in place to form a completed wafer connector component.
FIG. 13A is a partial sectional view of the wafer connector component of FIG. 11, taken along the angled line 13-13 thereof.

A cover member 250 is utilized to protect the dual beam contacts 217*a*, 217*b* and such a cover member 250 is shown in FIGS. 10 through 11 as one of a construction that covers the front end of only a single wafer connector element. The cover member 250 is shown in place upon the wafer connector component 202 in FIG. 11, and it serves as a protective shroud for the dual beam contacts 217*a*, 217*b*. The cover member 250 is preferably molded from an insulative material, such as a plastic that also may be chosen for a specific dielectric property. The cover member 250 has an elongated body portion 251 that extends vertically when applied to the wafer connector component 202 and the body portion 251 includes spaced-apart top and bottom engagement arms 252, 253. In this manner, the cover member 250 has a general U-shape when viewed from the side, and as illustrated in FIG. 10, it generally fits over the contact portions 216 of the terminals 206 of the wafer connector components 202, while the arms 252, 253 engage the wafer connector component 202 and serve to hold it in place.

Figure 10A:
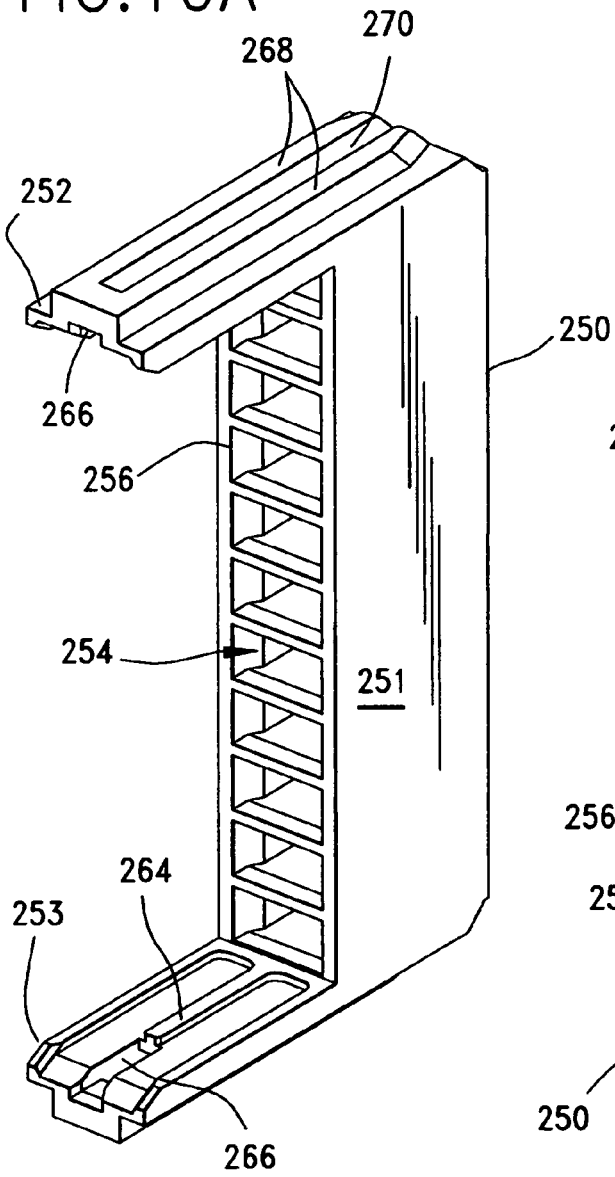
FIG. 10A is the same view as FIG. 9, but taken from the opposite side and illustrating the interior of the cover member.
Figure 10B:
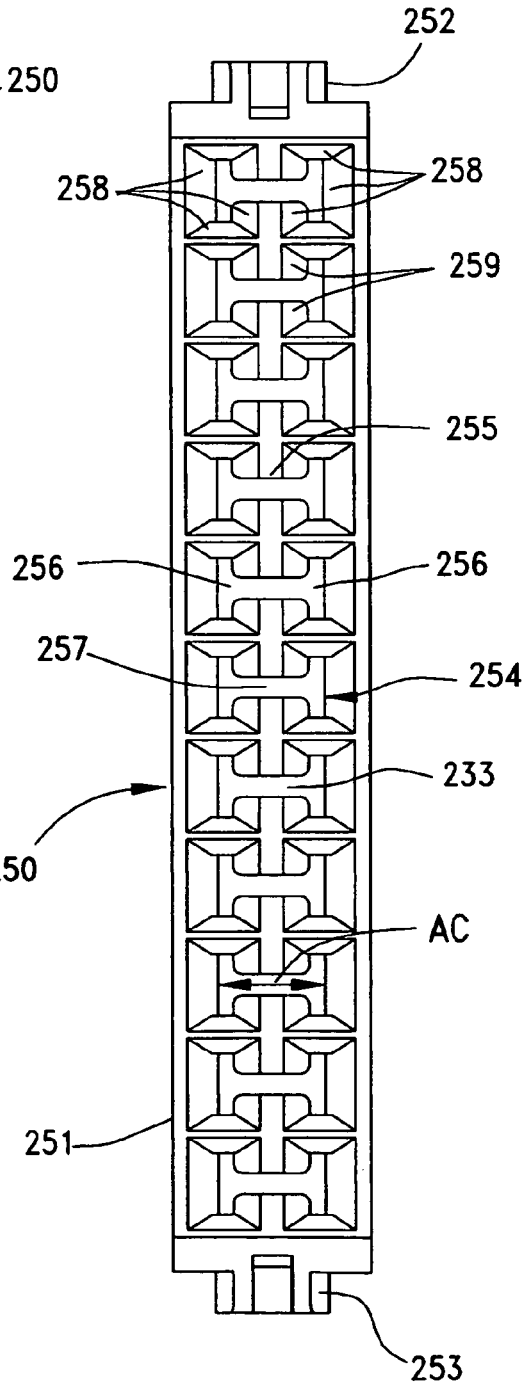
FIG. 10B is a front elevational view of the cover member of FIG. 10, illustrating the I-shaped channels of the mating face thereof.
Figure 10C:
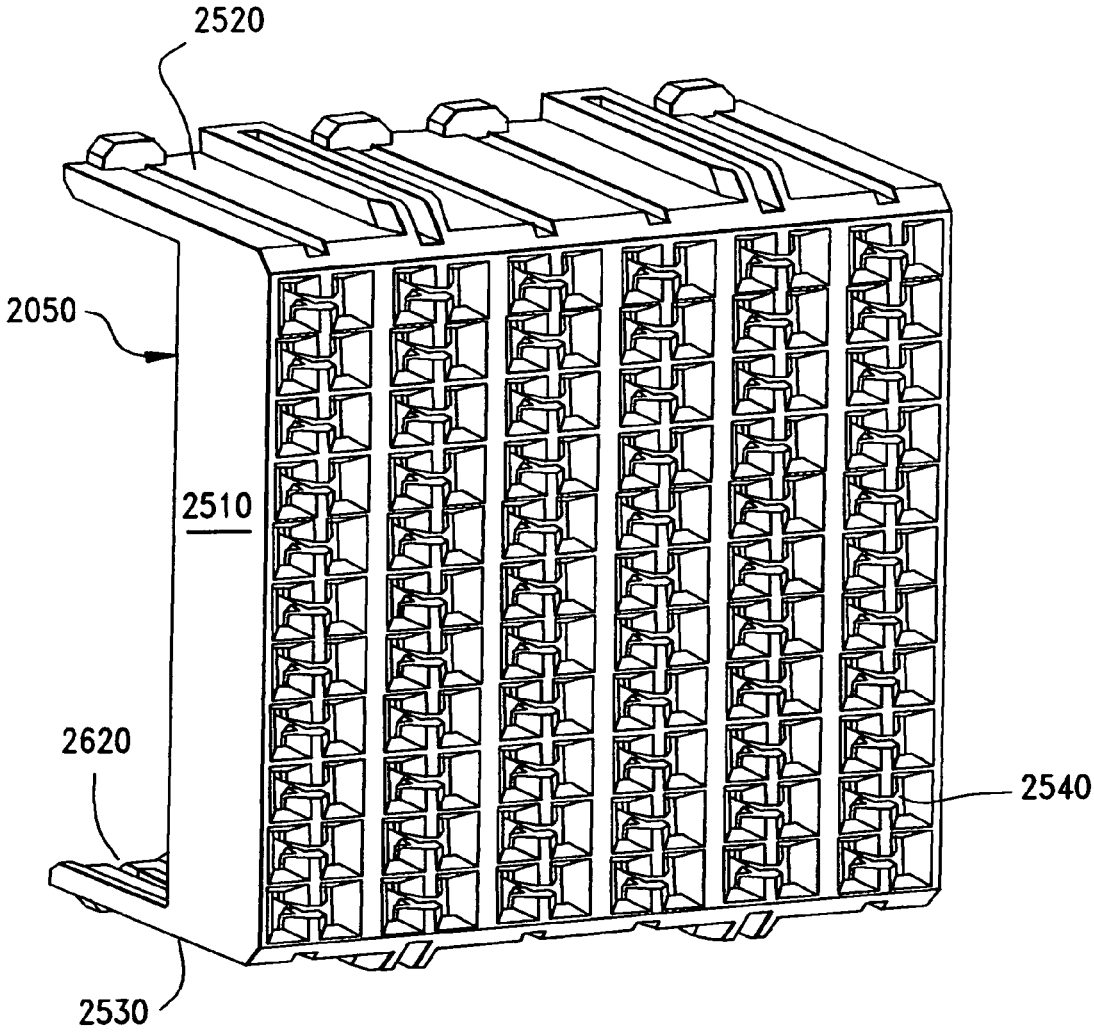
FIG. 10C is a frontal perspective view of the cover member that receives therein, the front ends of a plurality of connector elements of the style illustrated in FIG. 9.

The cover member 250 is formed with a plurality of cavities, or openings 254, and these are shown best in FIGS. 10 and 10B. The cavities 254 are aligned which each other in side-by-side order so that they accommodate a horizontal pair of terminal contact portions 216 of the wafer connector component 202. The cover member 250 may also include various angled surfaces 258 that serve as lead ins for the terminals 120 of the backplane member 100. As shown best in FIG. 10B, each such cavity 254 has a general H-shape, with the dual beam contacts 216 being received in the leg portions 256 of the H-shape. The leg portion openings 256 are interconnected together by intervening arm portions 257 of the H-shape, and these arm portions 257 are free of any terminal or wafer material so that each one acts as an air channel AC that extends between opposing surfaces of the dual beam contacts 217. As is the case with the backplane member H-shaped cavities 111, the cavities 254 of the cover member 250 also permit broadside coupling between the terminal contact portions 216 of the wafer connector component. FIG. 10C illustrates a cover member 2050 that is wider than just a single connector wafer element as in FIGS. 10-10B. This cover member 2050 includes internal channels 2620 formed in the interior surfaces of the end walls 2520, 2530 which extend between the side walls 2510 thereof. The cover member 2050 includes the H-shaped openings 2540 and angled lead-in surfaces in the same fashion as those shown and described for the cover member 250 to follow.

Figure 12:
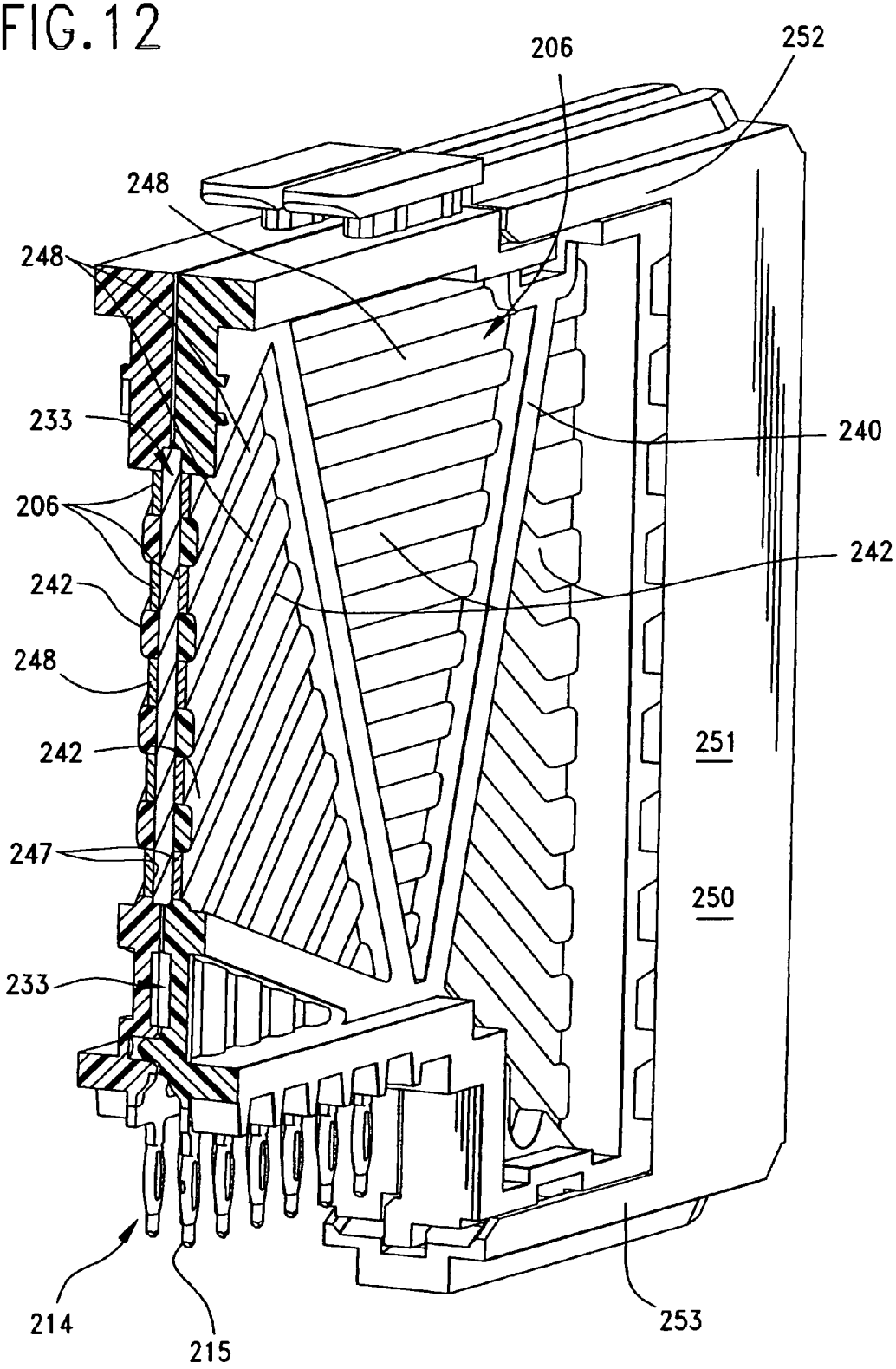
FIG. 12 is a sectional view of the wafer connector component of FIG. 11, taken along the vertical line 12-12 thereof.

In this manner, the air channel AC that is present between horizontal pair of terminals 206 (and which is shown in FIG. 12) of the wafer connector component 202 is maintained through the entire mating interface from the connector element tail portions mounted to the circuit board, through the wafer connector component, and into and through the backplane or header connector. It will be appreciated that the air channels 257 of the cover member cavities 254 are preferably aligned with the air channels 113 of the backplane member cavities 111.

Figure 11A:
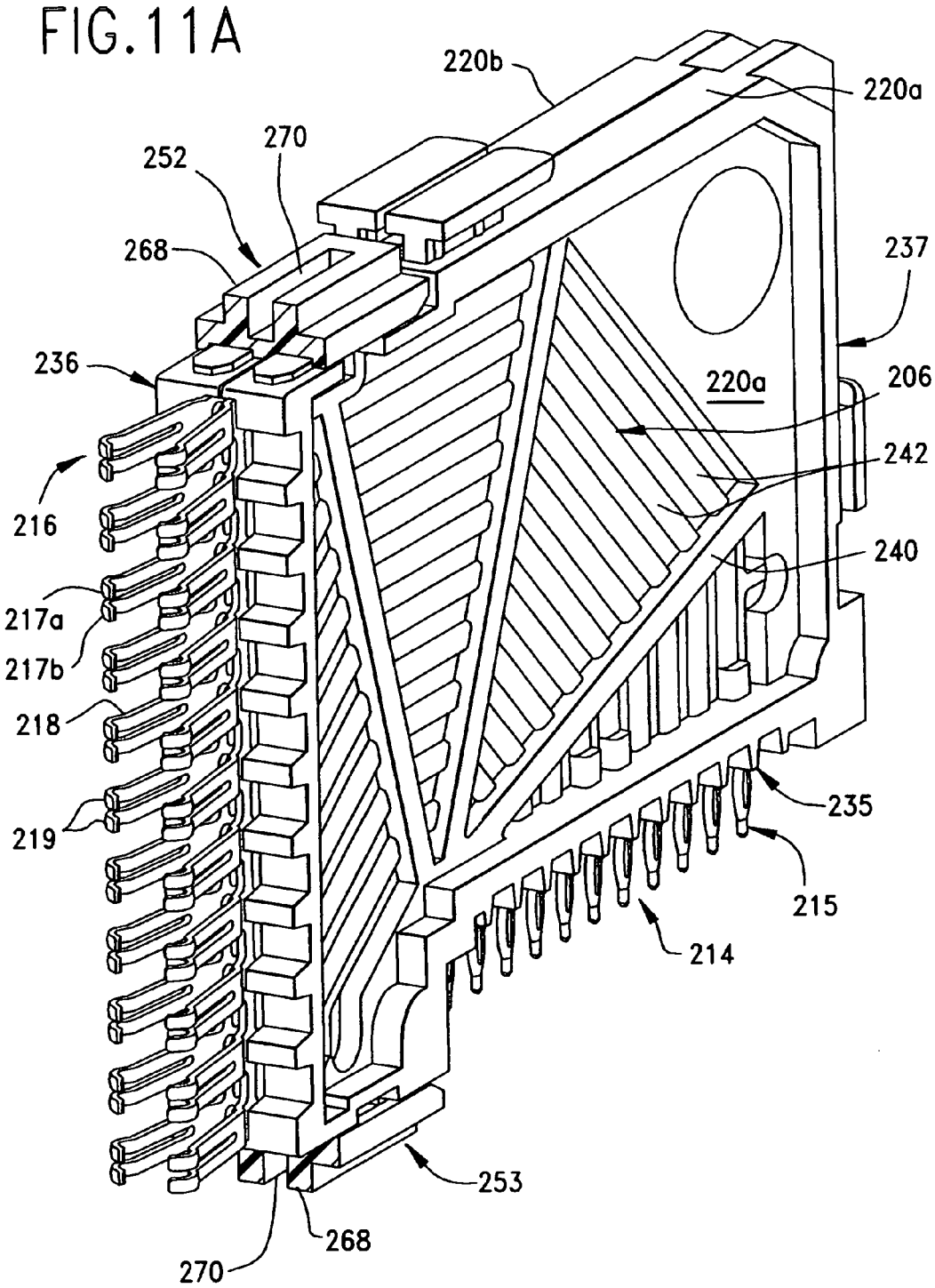
FIG. 11A is a sectional view of the wafer connector component FIG. 11, taken from the opposite side and along lines A-A of FIG. 11, with a portion of the cover member removed for clarity.
Figure 11B:
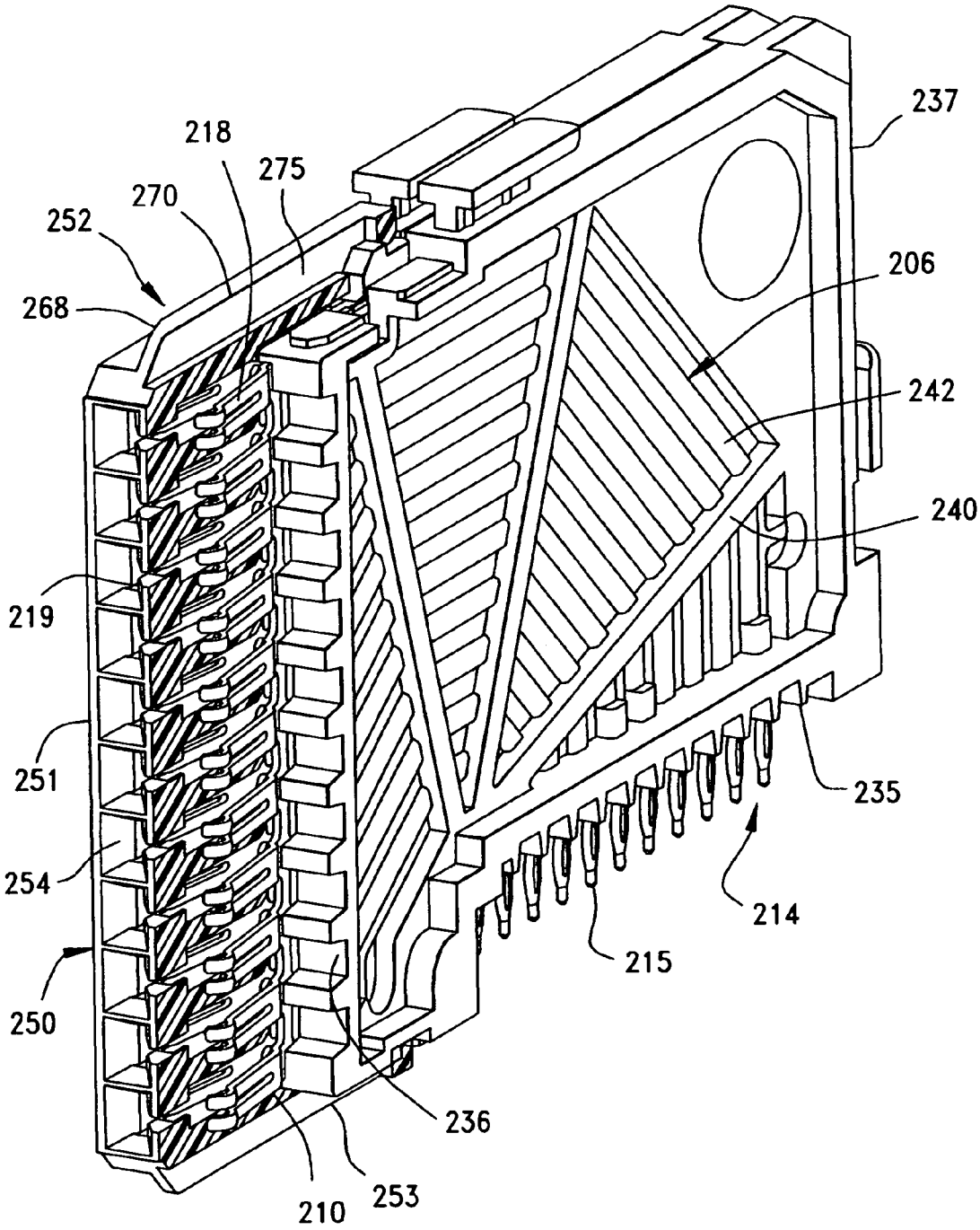
FIG. 11B is the same perspective view as FIG. 11, taken from the opposite side and sectioned along lines B-B of FIG. 11, illustrating how the terminal contact portions are contained within the interior cavities of the cover member.

As shown in FIG. 10, the cover member 250 may include a pair of channels 262, 263 that are disposed on opposite sides of a central rib 264 and which run for the length of the cover member 250. These channels 262, 263 engage and receive lugs 264 that are disposed along the top edge of the wafer connector component 202. The cover member arms 252, 253 also may contain a central slot 275 into which extends a retaining hook 276 that rises up from the top and bottom edges 234, 235 of the wafer connector component. The manner of engagement is illustrated in FIG. 11B and the cover member arms 252, 253 may be snapped into engagement or easily pried free of their engagement with the wafer connector component 202.

FIG. 12 illustrates the mating interface between the two connector components and it can be seen that the forward portion of the cover members 250 fit into the channels 110 of the backplane member 100. In doing so, the blade contact portions 122 of the backplane member terminals 120 will enter the cover member cavities 254 and the distal tips, i.e. the curved ends 219, of the dual beam contacts 217 will engage the inner surfaces 125 of the pairs of backplane member terminals 120. The backplane member terminal blade contact portions will then flex slightly outwardly against the inner walls of the cover member 250 and this contact ensures that the contact blades 122 will not deflect excessively. Additionally, the cover member 250 includes central walls 259 that flank the center air channel slots 257 and these walls 259 are angled and their angled surfaces meet with and contact the offset which is present in the backplane member terminal body portions 126. The ribs 130 of the terminal body portions 126 of the backplane member terminals 120 may be aligned with the air channel slots 257.

Figure 13B:
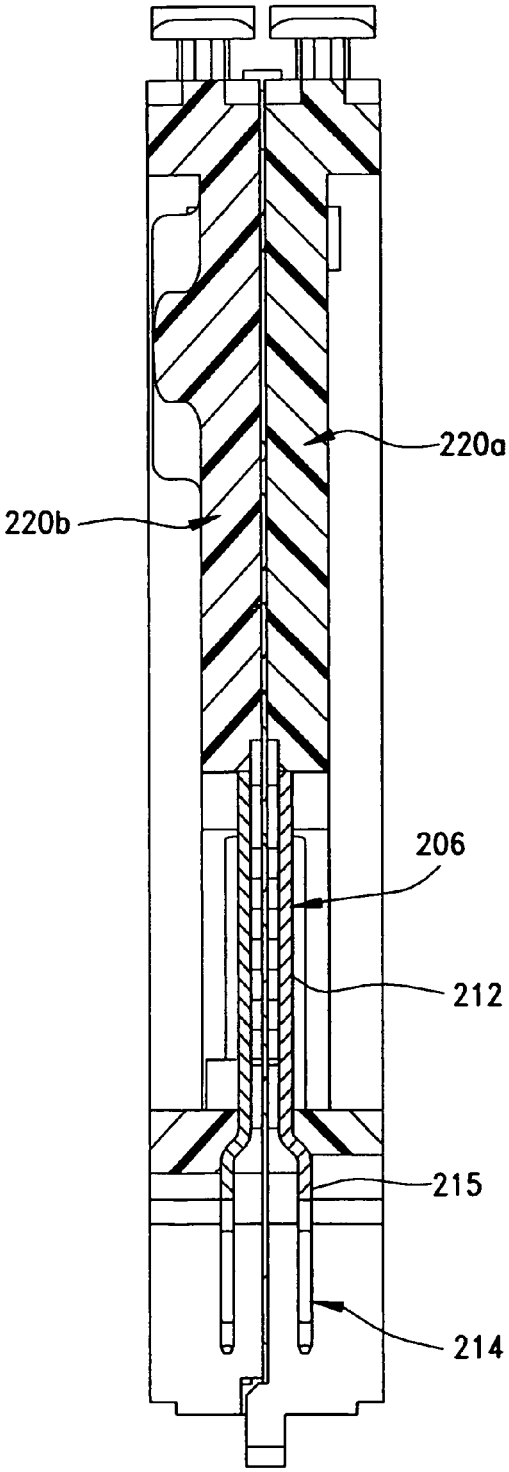
FIG. 13B is the same view as FIG. 13A, but taken directly from the front of the section shown in FIG. 13A.

FIG. 13 illustrates how the compliant portions 215 of the wafer connector component connector terminal tail portions 214 are spaced further apart in the tail area than in the body of the wafer connector component 202. The tail portions 214 are offset and the space between adjacent pairs of tails is left empty and is therefore filled with air. No wafer material extends between the pairs of terminal tails 214 so that the air gap that is present in the body of the wafer connector components is maintained at the mounting interface to the circuit board.

Figure 2:
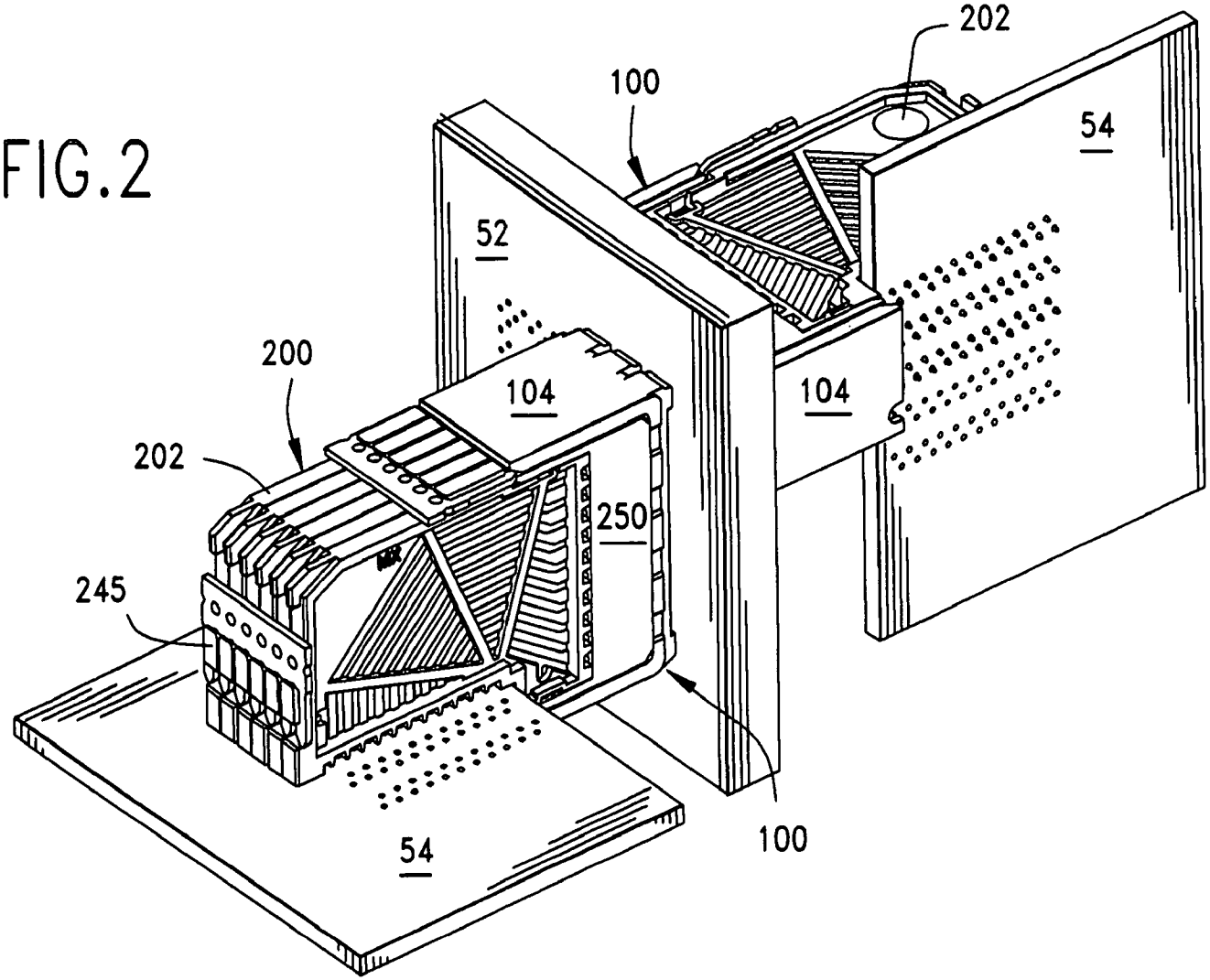
FIG. 2 is a perspective view of two backplane connectors of the present invention used in an orthogonal orientation to join circuits on two circuit boards together.

The terminal tails 214 are also offset in their alignment and this offset only encompasses the compliant tail portions 215. The legs of the H-shaped cavities 111 can be seen in FIG. 5A as including a slight offset. This is so that the terminals 120 need be only of one shape and size, and one row may be turned 180 degrees from the other row of terminals and inserted into the cavities 111. The body portions 126 and the blade contact portions 122 are not offset so the offset of the leg portions 126 of the terminal-receiving cavities 111 ensures that the flat contact blade and the (offset parts of the) body portions are aligned with each other to maintain coupling. Secondly, the tails are then offset from each other by about 45 degrees. This permits the use of a favorable via pattern on the mounting circuit board and permits the connector assembly to be used in orthogonal midplane applications, such as is shown in FIG. 2.

FIGS. 20-26 illustrate an alternate embodiment of a connector constructed in accordance with the principles of the present invention, but utilizing a structure of a header for attachment to a circuit board and joining two circuit boards together. In FIG. 20, a header connector 400 is shown mounted to a circuit board 401. In this embodiment, a plurality of conductive terminals are held together within an exterior housing, or cover member 402. The cover member 402 is the same shape and size as one of the cover members described in earlier embodiments, and it is preferably formed from an insulative material. The connector 400 is used to mate to another, opposing pin header or backplane connector 100 of the type as described hereinabove with respect to FIGS. 3-5D. Such a header 100 includes conductive terminals in the form of blade terminals 120 that terminate at their opposing ends in tail portions 123 that utilize compliant pins 124 which are inserted into holes or vias of the circuit board 124.

Figure 21:
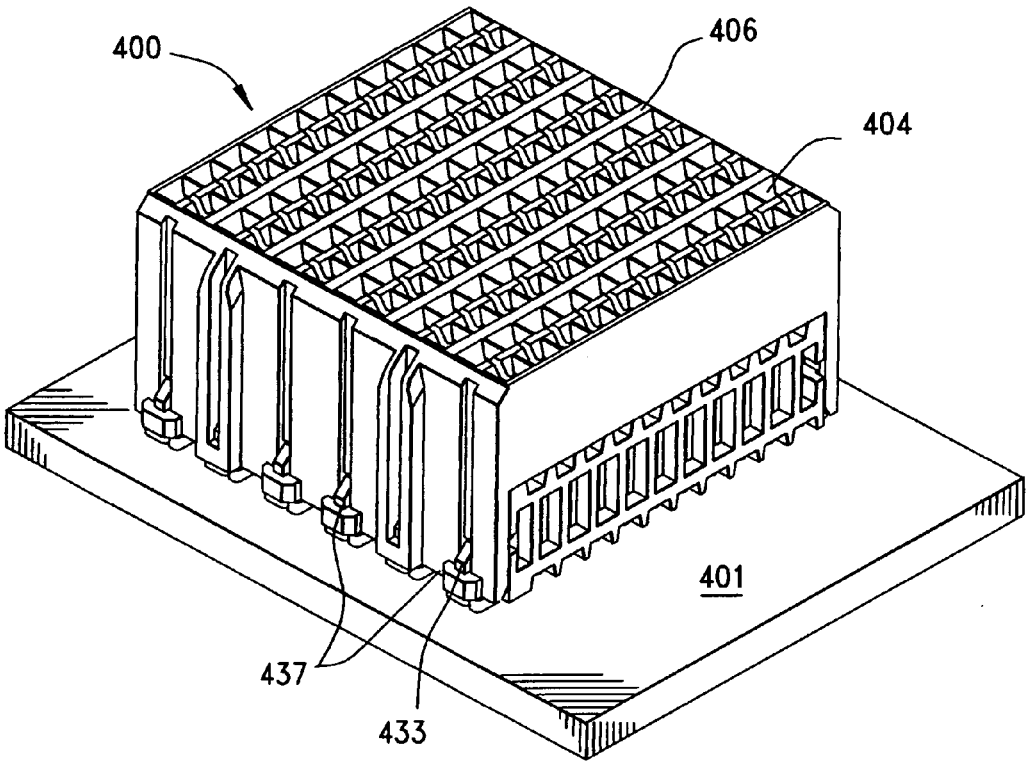
FIG. 21 is a perspective view of the stacker connector of FIG. 20.
Figure 21A:
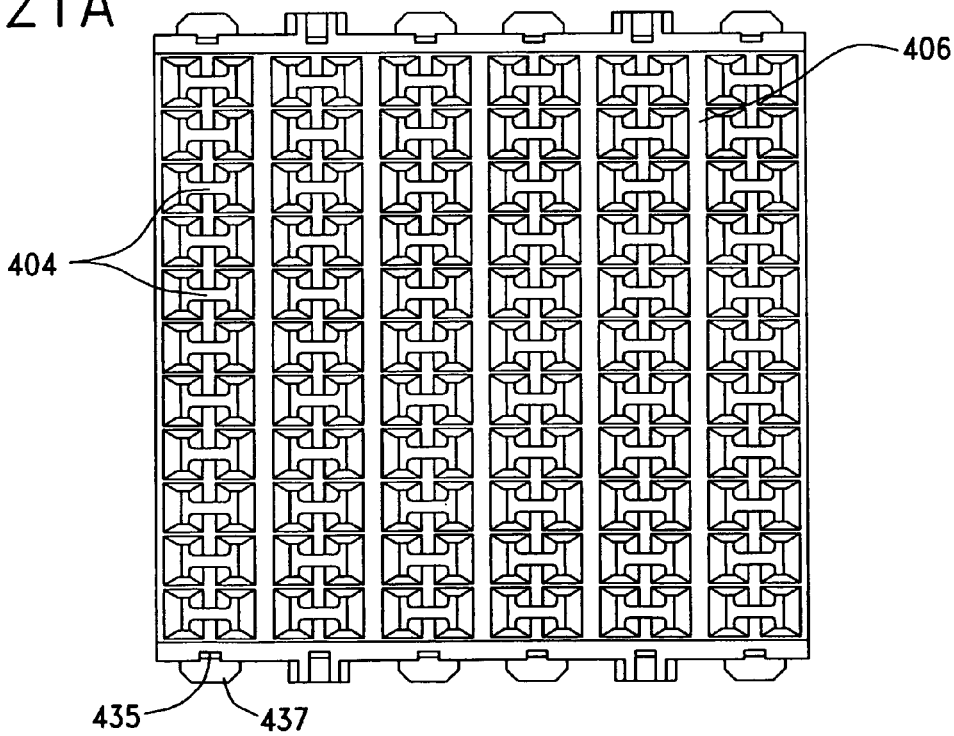
FIG. 21A is a top plan view of the connector of FIG. 21.

As seen in FIGS. 21 & 21A, the cover member 402 of the header connector 400, when viewed from the top, includes a plurality of rows of openings 404. These openings are arranged in columns and preferably two such columns are arranged in side-by-side prder between lateral walls 406 of the cover member 402. The openings 404 preferably are generally H-shaped, and as described earlier, they provide an air channel between the two contact portions of the terminal assemblies which are held within the hollow interior portion of the cover member 402. The vertical leg portions of these H-shaped openings 404 accommodate the bifurcated contact arms as explained above with respect to other embodiments of the invention.

Figure 22:
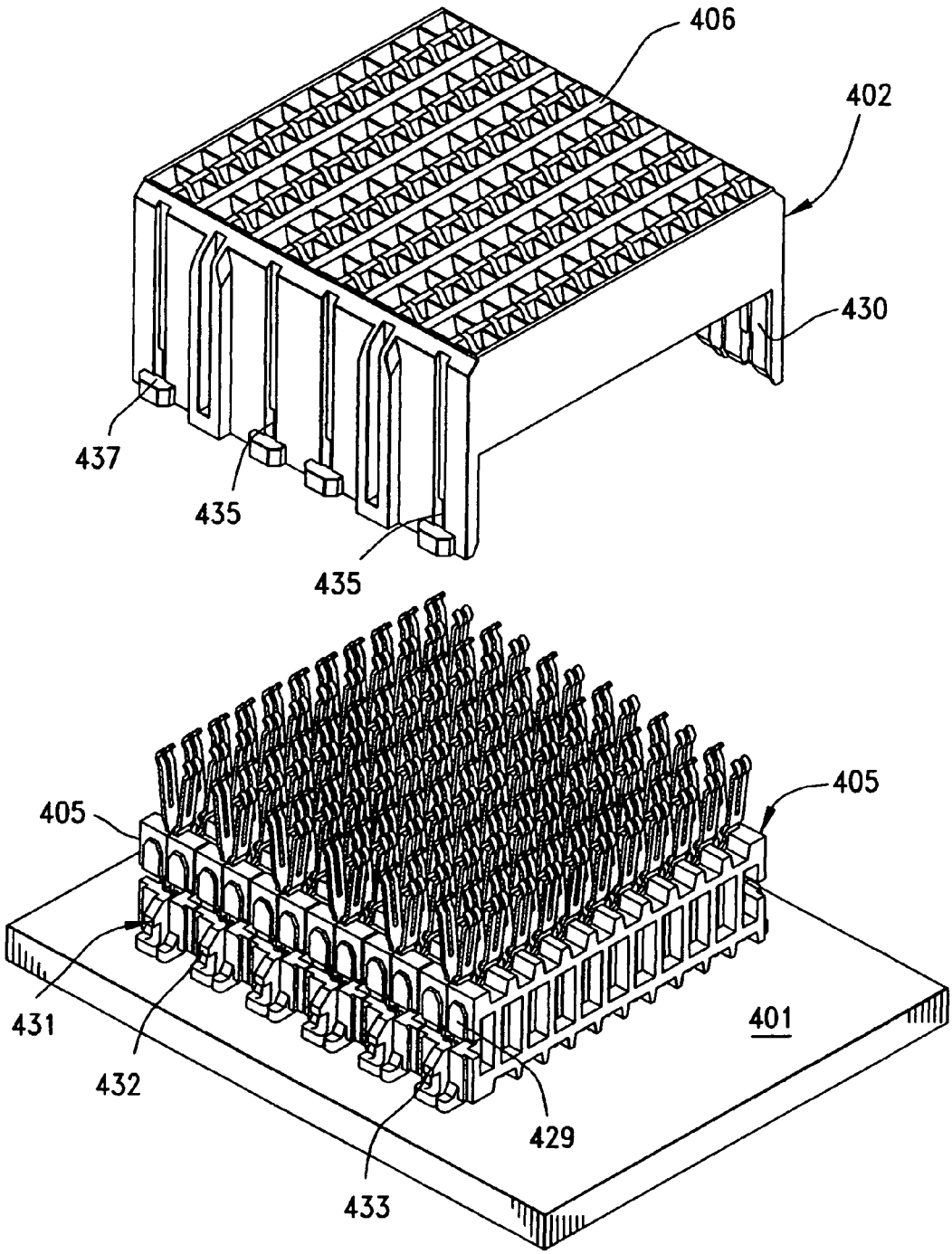
FIG. 22 is the same view as FIG. 21, but with the cover member removed for clarity from the interior terminal assemblies.

As shown best in FIG. 22, the cover member 402 encloses a series of terminal assemblies 405, with each of the terminal assemblies including an insulative base 407 that supports a plurality of conductive terminals 409, in sets of pairs, 410, with two terminals facing each other and defining a single pair. Such a terminal pair may be two differential signal terminals, a ground terminal and a single-ended signal terminal or two ground terminals. When the facing terminals are differential signal terminals, this embodiment 400 permits broadside coupling completely through the connector, from the contact portions 412 down through to the point where the terminal tail portions 414 enter the circuit board 401.

Figure 23:
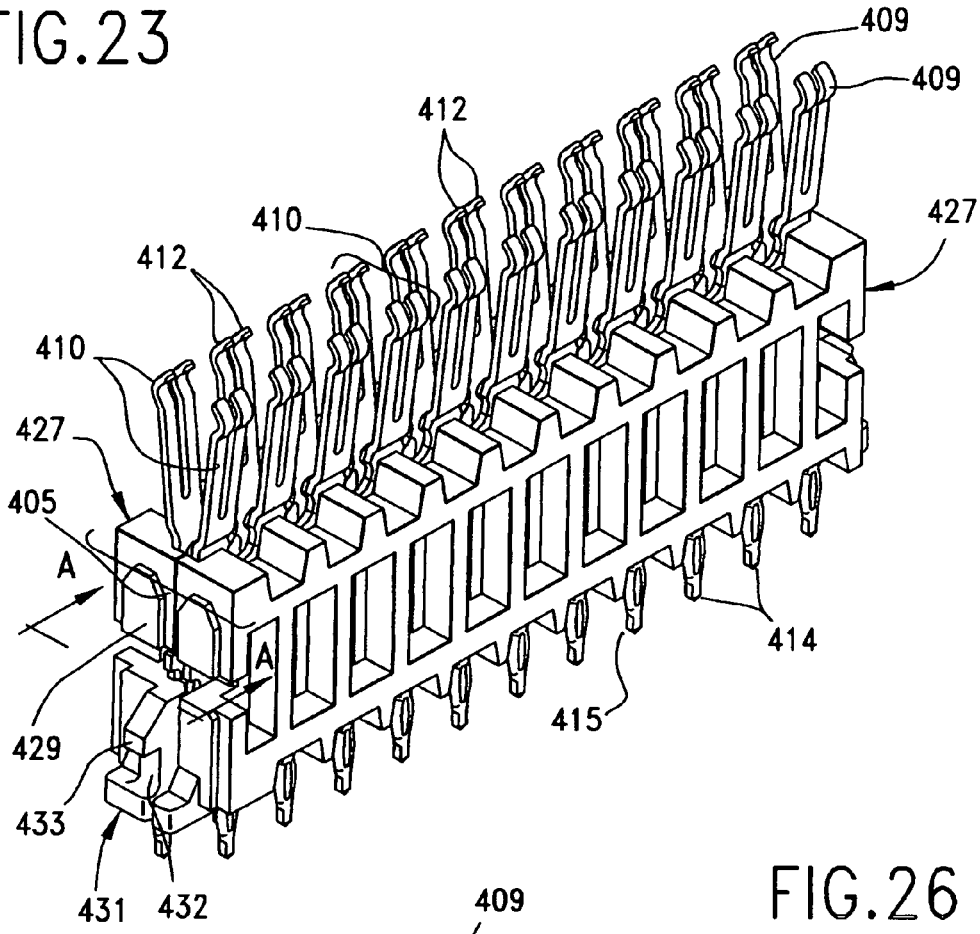
FIG. 23 is a perspective view of one of the terminal assemblies used in the connector of FIG. 21.
Figure 26:
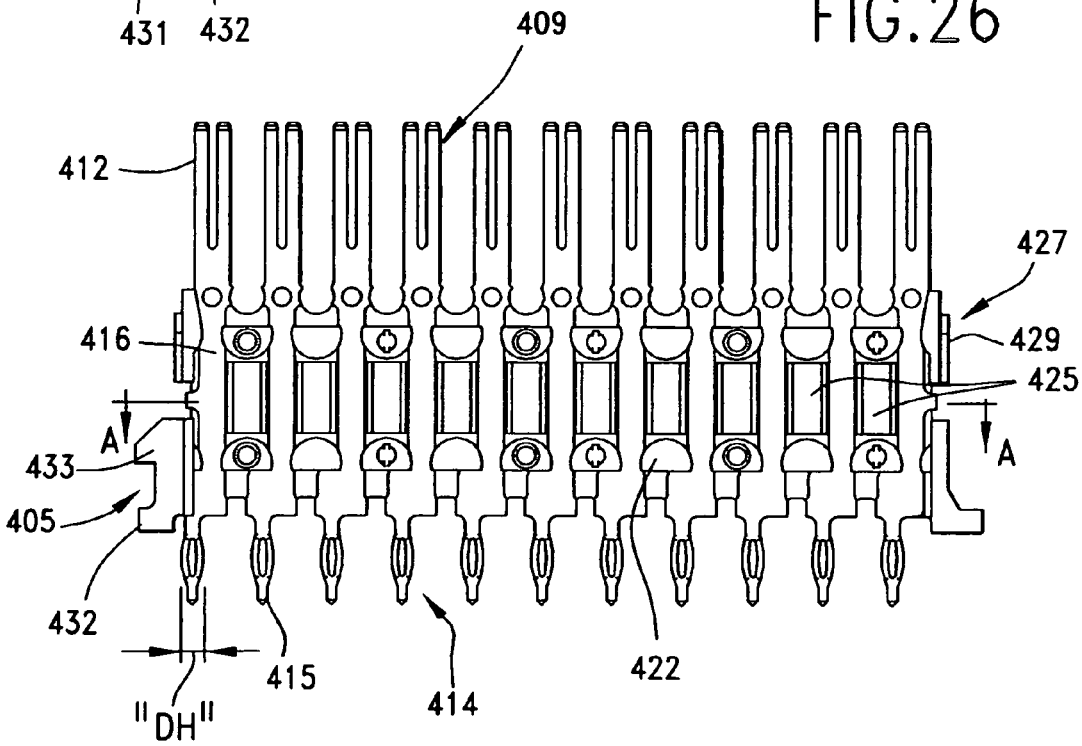
FIG. 26 is an elevational view of the leftmost terminal assembly of FIG. 24; and, FIG. 26A is a sectional view taken along lines A-A of FIG. 26.

Turning to FIG. 23, a single terminal assembly 405 is illustrated. The assembly 405 has two interengaging parts that cooperatively hold pairs of terminals 409 in opposition to each other, and the terminals are seen to include bifurcated contact arms 412 at the contact ends of the terminals. The contact ends of the terminal are angled slightly outwardly for reliable contact with opposing blade contacts of a mating connector. The terminals 409 have tail portions 414 that are preferably formed as complaint pin members 415, and as with the earlier embodiments of the present invention, the compliant pin members 415 are offset outwardly with respect to the body portions 416 (toward the upper left and bottom right in FIG. 24 and into the plane of the paper in FIG. 26) so that they enter vias on the circuit board 401 outwardly of the terminal body portions. As shown in FIG. 26, the compliant pins 415 are further offset from the centerlines of each terminal body portion 416 by a distance DH.

Figure 24:
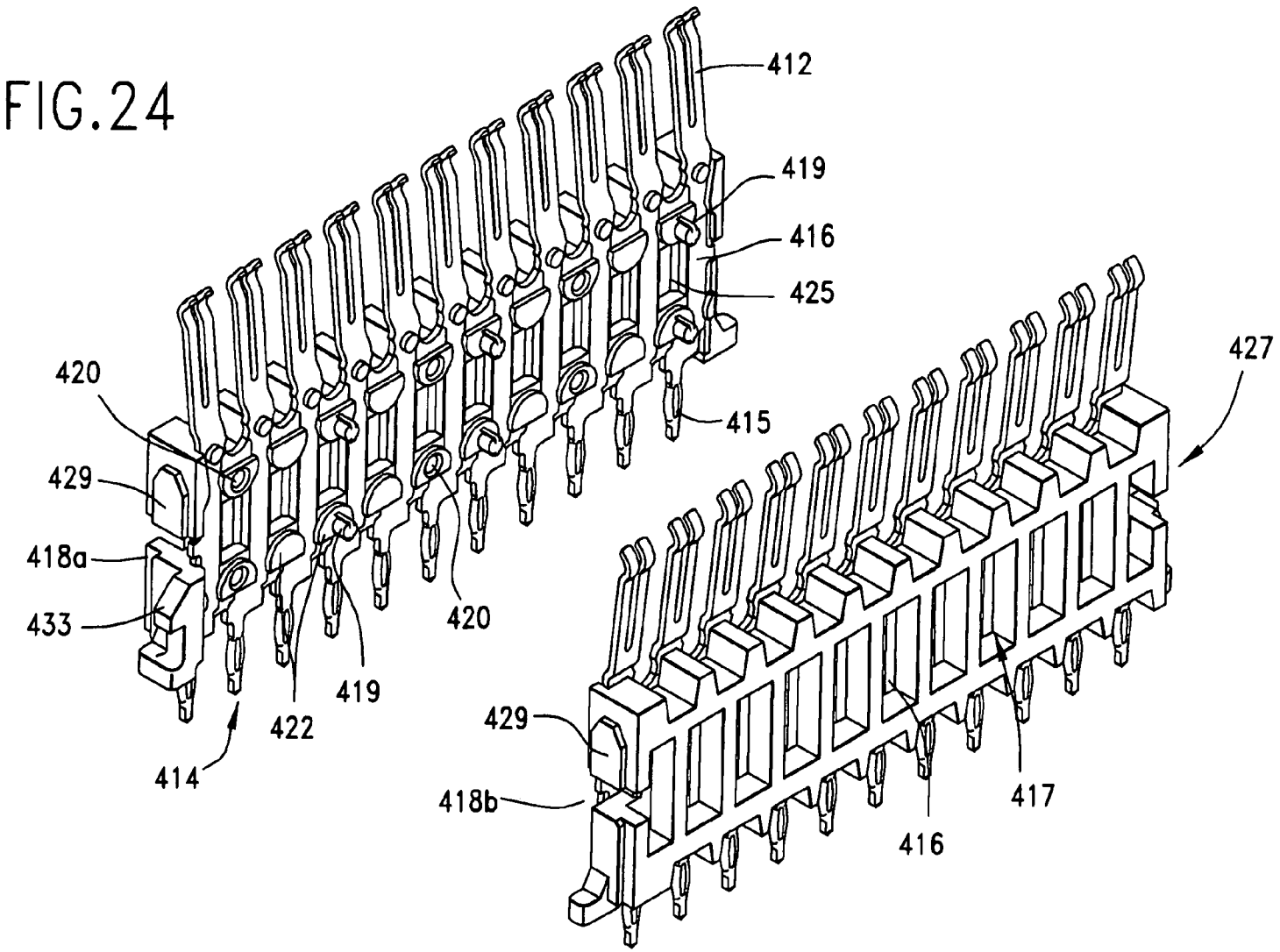
FIG. 24 is the same view as FIG. 23, but with the two halves of the terminal assemblies spaced apart from each to shoe the interior structure thereof.
Figure 25:
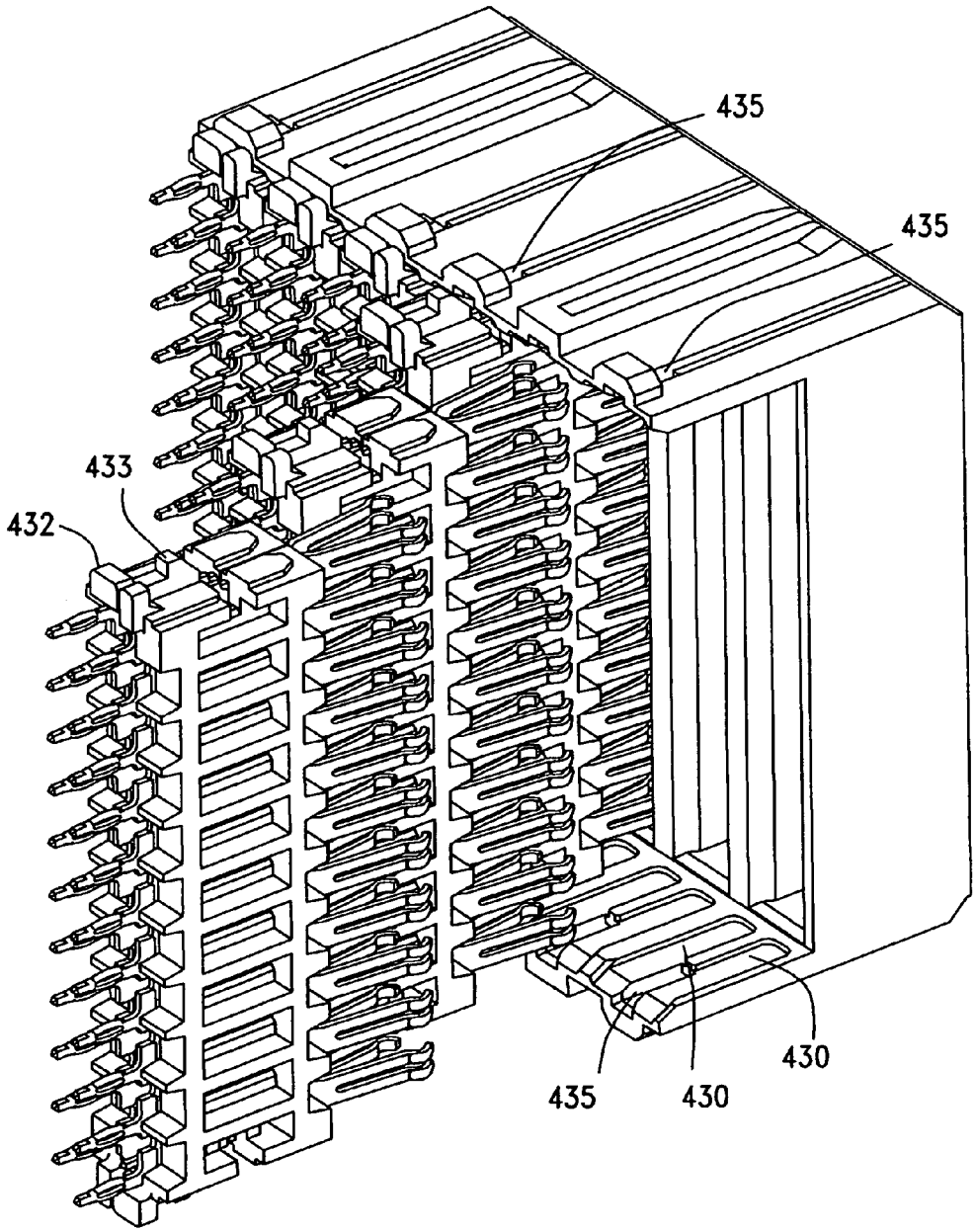
FIG. 25 is a perspective view of the connector of FIG. 21, taken from the underside thereof, illustrating two of the terminal assemblies partly removed from within the cover member and illustrating the internal structure of the cover member.

As shown in FIG. 24, the terminal assemblies are formed of two half portions 418*a,b* that are interlocked together with posts 419 fitting into holes 420 formed therein. These posts and holes are preferably formed in standoff portions 422 that are formed as part of the overall assembly of the terminal assemblies, preferably when the half portions are molded around the individual terminals. These standoff portions 422 also serve to provided the desired spacing between the terminals, in pairs. As seen in FIG. 24, the terminal assembly half portions 418*a,b* each have interior recesses 425 that extend in an outwardly direction with respect to the terminal body portions 416 and the depth of these recesses preferably is greater than the thickness of the terminal body portions 416. The width of these recesses DC is preferably the same as the spacing between facing terminals DT. These interior recesses serve to isolate the face-to-face (broadside) pairs of terminals from each other and by using the air contained in the recesses, serve to lessen the likelihood that edge coupling occurs between adjacent terminal pairs. These recesses, we term "castellations" for in cross-section, as shown best in FIG. 26A, they resemble the battlements on a castle wall. The terminal assembly half portions 418*a,b* also include exterior slots 417 that open up to the terminal body portions 416 and provide air as a dielectric medium in the terminal assemblies, rather than a metal shield plate, thus reducing the cost of the connector. They also utilize air in a spacing between adjacent terminal pairs in the transverse direction to provide electrical separation between pairs of terminals. In this manner, an air channel is defined, in a broadside manner, between pairs of the terminals from the contact portions 412 down to the tail portions 414, the result of which is to create high intensity coupling energy between differential signal pairs of terminal, while reducing the area where cross talk energy may occur. The spacing that is provided by the castellations provides an air dielectric between edges of the terminals and reduces the amount of edge coupling that will occur in the connector.

The lateral ends 427 of the terminal assemblies each preferably include a guide 429 formed on each half portions that extends outwardly. These guides 429 are received within interior slots 430 of the cover member 402. The lateral ends of the terminal assemblies 405 may also preferably include a retainer 431 in the form of an outwardly extending catch 432. The catch 432 may take the form of a hook with a free end 433 that is received within a corresponding track 435. This hook end 433 engages a shoulder 437 that is formed in the cover member (FIG. 21) and serves to retain the terminal assemblies in place in the cover member 402. Guides 439 formed on the outer surfaces of the cover member 402 may be received within the interior grooves 110 of the opposing, mating connector. In this embodiment, the same mating interface is used as in earlier embodiments, namely blade contacts and bifurcated contacts, but in a smaller height form factor than if the wafer-style connector elements described above were to be used.

While the preferred embodiment of the invention have been shown and described, it will be apparent to those skilled in the art that changes and modifications may be made therein without departing from the spirit of the invention, the scope of which is defined by the appended claims.

We claim:

1. A header connector for providing a pin field on a circuit board, comprising:

a cover member, the cover member having pairs of opposing end walls and side walls that cooperatively define a hollow interior portion, said cover member including a plurality of terminal mating openings disposed therein;

a plurality of terminal assemblies disposed in the hollow interior portion, each terminal assembly supporting a plurality of conductive terminals extending in two, spaced apart rows between the cover member end walls, each of said terminals including a contact end and a tail end interconnected together by a body portion, the terminals of each of said rows being aligned broadside with each other in pairs of terminals, said terminals of each pair being spaced apart from each other by intervening air channels; and, the terminal mating openings of said cover member including pairs of slots that receive said terminal contact portions therein, the pairs of slots being interconnected by intervening openings that open to said air channels separating said pairs of terminals.

2. The header connector of claim 1, wherein said terminal tail portion include compliant pin portions, said compliant pin portions of said two terminal rows being offset transversely within each of said terminal pairs, such that a spacing between pairs of compliant pin portions is greater than a spacing between pairs of terminal body portions.

3. The header connector of claim 1, wherein said terminal tail portions include compliant pin portions which are laterally offset from said terminal body portions such that centerlines of said compliant pin portions are spaced apart from centerlines of said compliant pin portions.

4. The header connector of claim 1, wherein said terminal mating openings are H-shaped.

5. The header connector of claim 1, wherein each of said terminal assemblies includes a pair of interengaging halves formed of an insulative material.

6. The header connector of claim 5, wherein each of said terminal assembly halves includes a plurality of standoff portions that extend outwardly therefrom in opposing directions, said standoff portions spacing said terminal body portions of said two rows within said terminal assembly apart from each other.

7. The header connector of claim 1, wherein said terminal contact ends include pairs of spaced-apart contact arms, two of the pairs of contact arms being received within said terminal mating openings.

8. The header connector of claim 7, wherein said terminal mating openings are H-shaped, the cover member including a plurality of H-shaped openings disposed therein, the contact arms of an associated pair of terminals at least partially occupying four corners of the H-shaped openings.

9. A connector assembly for joining two circuit boards together, comprising:

a first connector which includes a cover member, the cover member having pairs of opposing end walls and side walls that cooperatively define a hollow interior portion, said cover member further including a mating face;

a plurality of terminal assemblies disposed in the hollow interior portion, each terminal assembly supporting a plurality of conductive terminals extending in two, spaced apart rows between the cover member end walls, each of said terminal including a contact end and a tail end interconnected together by a body portion, the terminals of each of said rows being aligned broadside with each other in pairs of terminals, said terminals of each pair being spaced apart from each other by intervening air channels;

a second connector, including a header member that mates with said connector, the header member including an insulative base portion with a plurality of openings formed therein, each of the openings supporting a pair of conductive terminals therein, the terminals including blade contact portions and tail portions at opposite ends thereof, the blade contact portions being arranged within said header member so that said connector contact arms slide against when said connector and header member are mated together, said header member openings having H- shaped configurations, each of the header member openings including a pair of parallel leg portions interconnected by a cross portion so that pairs of said header member terminals are received within said leg portions of each opening and said cross portions define air channels between said pairs of header member terminals.

10. The connector assembly of claim 9, wherein said base portion openings include channels that extend between pairs of said terminals.

11. The connector of claim 9, wherein said header member includes a pair of end walls, the end walls including grooves that engage said connector cover member to guide said cover member into said header member.

12. The connector assembly of claim 9, wherein each of said second connector terminals include a compliant pin tail portions, the compliant pin tail portion being offset from a centerline of said blade contact portion, and said header member base portion openings are H-shaped, the compliant pin portions of opposing pairs of second connector terminals being disposed in angled, opposing corners of said H-shaped openings.

13. The connector of claim 12, wherein said header member terminal tail portions include compliant pin tail portions, the compliant pin tail portion being offset from a centerline of said blade contact portion for each of said second connector terminals.

14. The connector assembly of claim 9, wherein said cover member includes a plurality of H-shaped terminal mating openings disposed therein, the terminal mating openings including pairs of slots that receive said terminal contact portions therein, the pairs of slots being interconnected by intervening openings that open to said air channels separating said pairs of first connector terminals.

15. The connector assembly of claim 14, wherein said first connector terminal contact ends include pairs of spaced-apart contact arms, two of the pairs of contact arms being received within said terminal mating openings, the contact arms of an associated pair of said first connector terminals at least partially occupying four corners of the H-shaped openings.

16. A header connector, comprising:

an insulative base portion with a plurality of openings formed therein, each of the openings supporting a pair of conductive terminals therein, each of the terminals including blade contact portions and tail portions at opposite ends thereof, the blade contact portions extending away from the base portion in one direction and the tail portions extending away from said base portion in another direction each of the base portion openings having an H-shape with a pair of parallel leg portions interconnected by a cross portion, pairs of said terminals being received within said leg portions of each opening, such that each one of said leg portions receives a single one of said terminals, and said cross portion defining an air channel between said terminal pairs, even when a mating connector is mated to said header connector.

17. The header connector of claim 16, wherein said terminal tail portions are compliant pin portions.

18. The header connector of claim 17, wherein the compliant pin portions are offset from centerlines of their respective blade contact portions.

19. The header connector of claim 17, wherein said compliant pin portions of pairs of contacts are disposed in opposing corners of said base portion openings.

20. A header connector, comprising:

an insulative base portion with a plurality of openings formed therein, each of the openings supporting a pair of conductive terminals therein, each of the terminals including blade contact portions for contacting terminals of a mating connector and tail portions for mounting the header connector to a circuit board, each of the base portion openings having a H-shape with a pair of leg portions interconnected by a cross portion forming the H-shape, the tail portions of pairs of terminals being disposed in angled, opposing corners of said openings.

* * * * *